US010098802B2

(12) United States Patent
Kurosawa

(10) Patent No.: US 10,098,802 B2
(45) Date of Patent: Oct. 16, 2018

(54) THERAPEUTIC APPARATUS AND THERAPEUTIC METHOD

(71) Applicant: Ryo Kurosawa, Katagami (JP)

(72) Inventor: Ryo Kurosawa, Katagami (JP)

( * ) Notice: Subject to any disclaimer, the term of this patent is extended or adjusted under 35 U.S.C. 154(b) by 709 days.

(21) Appl. No.: 14/353,454

(22) PCT Filed: Oct. 23, 2012

(86) PCT No.: PCT/JP2012/077306
§ 371 (c)(1),
(2) Date: Apr. 22, 2014

(87) PCT Pub. No.: WO2013/061949
PCT Pub. Date: May 2, 2013

(65) Prior Publication Data

US 2014/0276276 A1 Sep. 18, 2014

(30) Foreign Application Priority Data

Oct. 25, 2011 (JP) ..... 2011-233960

(51) Int. Cl.
*A61H 1/00* (2006.01)
*A61H 9/00* (2006.01)
(Continued)

(52) U.S. Cl.
CPC ..... *A61H 1/005* (2013.01); *A61H 9/0007* (2013.01); *A61H 9/0021* (2013.01);
(Continued)

(58) Field of Classification Search
CPC .... A61H 1/005; A61H 9/0007; A61H 9/0021; A61H 23/0236; A61H 2230/30;
(Continued)

(56) References Cited

U.S. PATENT DOCUMENTS 2,043,416 A * 6/1936 Lueg ..... F01N 1/065 181/197
5,291,748 A * 3/1994 Ueda ..... B60H 1/00742 236/78 D
(Continued)

FOREIGN PATENT DOCUMENTS

DE 20 2006 005 755 U1 8/2006
JP 60-225557 A 11/1985
(Continued)

OTHER PUBLICATIONS

Extended European Search Report dated Mar. 20, 2015 issued in corresponding EP Application No. EP 12843276.2.

*Primary Examiner* — Quang D Thanh
(74) *Attorney, Agent, or Firm* — Hawaii Patent Services; Nathaniel K. Fedde

(57) ABSTRACT

A therapeutic apparatus, which treats fatigue of the whole body, is provided. A plurality of speakers/sensors which apply an oscillating pressure to a subject are provided. An airtight chamber and a vacuum pump unit, which change the subject into the state of a negative pressure from the atmospheric pressure, are provided. A control unit adjusts distribution of the oscillating pressure by the output of each speaker/sensor is provided. Further, the control unit adjusts each speaker/sensor, in order that the oscillating pressure of a same extent is applied to a plurality of parts of the body, simultaneously. Thereby, the whole body of the subject can recover from fatigue.

18 Claims, 12 Drawing Sheets

X

(51) Int. Cl.
*A61H 23/02* (2006.01)
*A61G 10/02* (2006.01)

(52) U.S. Cl.
CPC ..... *A61H 23/0236* (2013.01); *A61G 10/023* (2013.01); *A61G 2203/34* (2013.01); *A61G 2203/44* (2013.01); *A61H 2009/0035* (2013.01); *A61H 2201/5071* (2013.01); *A61H 2201/5082* (2013.01); *A61H 2203/0456* (2013.01); *A61H 2203/0468* (2013.01); *A61H 2230/06* (2013.01); *A61H 2230/207* (2013.01); *A61H 2230/25* (2013.01); *A61H 2230/30* (2013.01); *A61H 2230/50* (2013.01); *A61H 2230/60* (2013.01); *A61H 2230/62* (2013.01); *A61H 2230/65* (2013.01); *A61H 2230/70* (2013.01); *A61H 2230/80* (2013.01); *A61H 2230/855* (2013.01)

(58) Field of Classification Search
CPC .... A61H 2009/0035; A61H 2201/5082; A61H 2203/0456; A61H 2203/0468; A61H 2230/855; A61H 2230/207; A61H 2230/25; A61H 2230/50; A61H 2230/60; A61H 2230/62; A61H 2230/65; A61H 2230/70; A61H 2230/80; A61H 2230/06; A61G 2203/44; A61G 10/023; A61G 2203/34
See application file for complete search history.

(56) References Cited

U.S. PATENT DOCUMENTS

| | | | | |
|---|---|---|---|---|
| 2003/0032900 | A1* | 2/2003 | Ella | A61H 7/008 601/6 |
| 2003/0154793 | A1 | 8/2003 | Omata | |
| 2005/0070825 | A1 | 3/2005 | Hagiwara | |
| 2006/0030907 | A1* | 2/2006 | McNew | A61B 5/02405 607/88 |
| 2007/0225618 | A1 | 9/2007 | Ward et al. | |
| 2009/0043293 | A1 | 2/2009 | Pankratov et al. | |
| 2009/0306555 | A1* | 12/2009 | Goto | A61H 5/00 601/15 |
| 2009/0312693 | A1* | 12/2009 | Thapliyal | A61M 37/0092 604/22 |
| 2011/0251535 | A1* | 10/2011 | Bender | A61M 21/02 601/49 |

FOREIGN PATENT DOCUMENTS

| | | | |
|---|---|---|---|
| JP | 11-290383 | A | 10/1999 |
| JP | 2003-169829 | A | 6/2003 |
| JP | 2004-89541 | A | 3/2004 |
| JP | 2007-296326 | A | 11/2007 |
| JP | 2008-70821 | A | 3/2008 |
| JP | 2009-207580 | A | 9/2009 |
| JP | 2010-535595 | A | 11/2010 |
| WO | WO 01/84135 | A1 | 11/2001 |
| WO | WO 02/11661 | A2 | 2/2002 |
| WO | WO 2009/023568 | A1 | 2/2009 |
| WO | WO 2010/013259 | A1 | 2/2010 |

* cited by examiner

THERAPEUTIC APPARATUS AND THERAPEUTIC METHOD

FIELD OF THE INVENTION

The present invention relates to a therapeutic apparatus and a therapeutic method, and in particular, relates to a therapeutic apparatus and therapeutic method using an oscillating pressure including a sound wave and a negative pressure.

BACKGROUND OF THE INVENTION

The mechanism of fatigue is not fully understood. One of the causes of fatigue or a disease is that unnecessary substances including wastes which occur inside of the body by daily activity are accumulated inside of the body and these substances are considered to obstruct blood flow, etc., and to reduce a bodily function.

Here, "unnecessary substances including wastes" is for example, the inside of the metabolic product which occurred by metabolism, energy metabolism, etc.; nitrogen compounds, which are substances unnecessary to a living body, such as ammonia, urea, and lithic acid, lactic acid, or active oxygen, or apoptosis cells, necrosis cells occurred by damage to tissue, etc.; and all the objects that should be excreted out of the body among the substances which occurred inside of the body by daily life are included (Hereinafter, these are collectively called "wastes").

Here, as referred to in the patent document 1, the conventional therapeutic apparatus is described as having a deformed portion which deforms and crushes by decompression, a pressing part which presses the lean figure part attracted by the inside of the suction cup in the suction cup at the time of modification, wherein the suction cup presses the pressing part the lean figure part (Hereinafter, it is called the conventional technology 1.).

By use of the suction cup of conventional technology 1, it is possible to eliminate shoulder stiffness, dissipate and remove unnecessary fat of the lean section, and remove the congestion of the affected area.

PRIOR ART DOCUMENTS

Patent Documents

[Patent Document 1]
JP2003-169829A

SUMMARY OF THE INVENTION

Problem(s) to be Solved by the Invention

However, the suction cup of conventional technology 1 had a limit in the breadth and time to suck. A reason is that pressing the large area of the skin under strong negative pressure or pressing under negative pressure for a long time can have a great burden on the body.

The present invention is achieved in view of such circumstances.

Means for Solving the Problem

A therapeutic apparatus of the present invention is a therapeutic apparatus for recovering a subject from fatigue. It comprises a plurality of oscillating pressure addition units for adding an oscillating pressure to the subject, and a negative pressure unit for changing a state of the subject to negative pressure from atmospheric pressure.

A therapeutic apparatus of the present invention comprises an adjustment device to adjust an output distribution of each oscillating pressure addition unit, and the adjustment device adjusts the oscillating pressure of the plurality of oscillating pressure addition units in order to apply a same extent of the oscillating pressure to a plurality of parts of a body simultaneously.

A therapeutic apparatus of the present invention further comprises a sensor to detect a pulse and blood pressure of the subject.

A therapeutic apparatus of the present invention is wherein the adjustment device controls an output of the negative pressure or the oscillating pressure based on a value detected by the sensor.

A therapeutic apparatus of the present invention is wherein the sensor detects a state of a body surface of the subject, including temperature, blood flow volume, or hardness of the body surface for the subject.

A therapeutic apparatus of the present invention is wherein the sensor provides a plurality of thermometers for detecting a position of the subject in three dimensions.

A therapeutic apparatus of the present invention is wherein the sensor detects reflection of microwave from the body surface of the subject and measures the hardness of the body surface of the subject.

A therapeutic apparatus of the present invention comprises a monitor to draw an output from each of the sensor in real time.

A therapeutic apparatus of the present invention further comprises a bed of meshed shape in which the subject is laid by supine or prone, and the plurality of oscillating pressure addition units are arranged to surround the subject.

A therapeutic apparatus of the present invention is wherein the adjustment device captures a motion of the body surface for the subject by analyzing information on the plurality of thermometers and measures the hardness of the body surface of the subject from a motion of the body surface for the subject in case of applying the oscillating pressure.

A therapeutic apparatus of the present invention is wherein the adjustment device stores data having transition of a vital sign including blood pressure and a pulse of the subject during therapy for every therapy, stores the data in a database, in correspondence with the subject.

A therapeutic apparatus of the present invention is wherein the oscillating pressure addition unit is a sound wave generator to apply a sound wave to the subject.

A therapeutic apparatus of the present invention is wherein the adjustment device uses an active noise controller for negating the phase of the sound wave or conversely emphasizing the difference in the strength of the sound wave by overlapping and reinforcing, or adjusts an output of the sound wave to remove an artifact including the sound wave added to the subject or an echo of the sound wave after being added.

A therapeutic apparatus of the present invention is wherein the sensor detects for the subject without contacting.

A therapeutic apparatus of the present invention is wherein the oscillating pressure addition unit is a liquid pressure addition part to inject a fluid towards the subject.

A therapeutic apparatus of the present invention is wherein the adjustment device adjusts an output of the fluid and adjusts to be applied the oscillating pressure by liquid pressure intermittently.

A therapeutic apparatus of the present invention comprises a flexible sheet to enclose at least a part of the body surface for the subject, and the liquid pressure addition part injects the fluid intermittently toward the body surface for the subject from the outside of the sheet and applies the oscillating pressure to the body surface of the subject.

A therapeutic apparatus of the present invention is wherein the sensor reads a position of a position presenting part of the sheet, measures a shape and a modification position of the sheet, and detects a state of the body surface of the subject.

A therapeutic apparatus of the present invention comprises a sterilization unit to sterilize inside of the apparatus for every therapy.

A therapeutic method of the present invention is a therapeutic method for recovering a subject from fatigue, comprising the steps of changing a state of the subject to negative pressure from atmospheric pressure by a negative pressure unit; and adding an oscillating pressure to the subject by a plurality of oscillating pressure addition units.

Effect of the Invention

According to the present invention, a patient is set under air pressure lower than atmospheric pressure by a negative pressure unit, and, simultaneously, to the whole body of the patient, the sound wave by the intermittent tone emitted from a plurality of speakers is projected, or the intermittent pressure (liquid pressure) via a fluid is applied, and the body surface is vibrated.

As result, the therapeutic apparatus, which recovers fatigue of the whole body of the patient without applying a burden to the patient, can be provided.

THE EMBODIMENTS OF THE INVENTION

A First Embodiment

[The Therapeutic Apparatus X Related to the First Embodiment of the Present Invention]

Here, the therapeutic apparatus X related to the first embodiment of the present invention is explained.

In the therapy by the therapeutic apparatus X related to the first embodiment of the present invention:

(1) Reduce air pressure for the patient rather than the atmospheric pressure, and, simultaneously, add vibration by applying an intermittent tone to body surface of the patient.

(2) At that time, by setting up the air pressure and the strength of the vibration added to the body surface appropriately, the air pressure can be reduced without a burden to the patient, and a function of a cardiovascular system of the patient can be reinforced. In addition, it is to be noted that care must be taken to prevent decompression sickness.

(3) Because the difference between air pressure and the internal pressure of the patient (blood pressure) becomes large, by the principle of filtration, the excretory process of the wastes from the skin can be promoted and a therapeutic effect can be acquired.

The configuration of the therapeutic apparatus X applied to this embodiment with reference to drawings is explained in detail as follows.

[External Appearance of the Therapeutic Apparatus X Related to the First Embodiment of the Present Invention]

Figure 1:
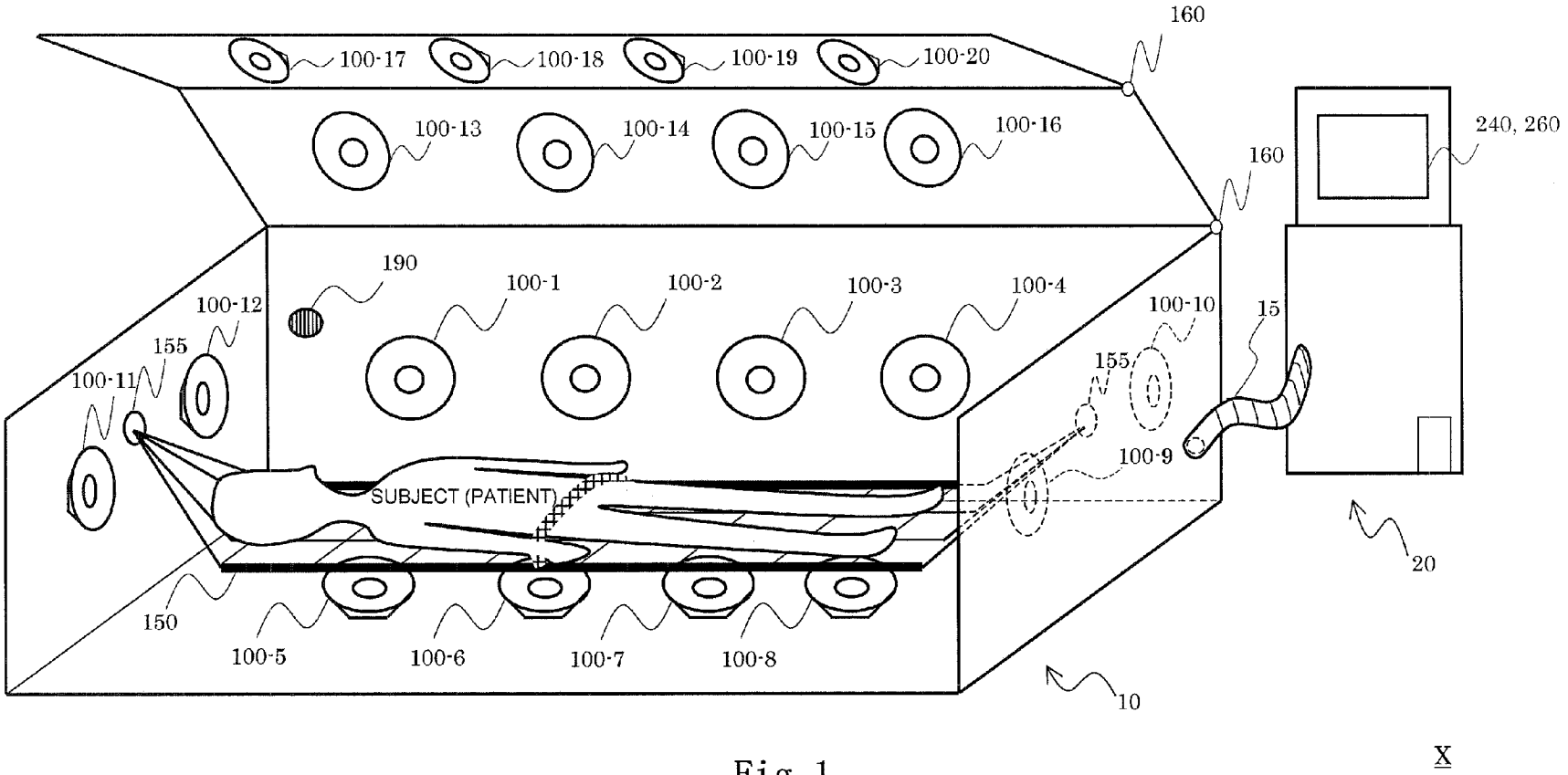
FIG. 1 is a conceptual diagram showing the external appearance of the therapeutic apparatus X related to the first embodiment of the present invention.

As refer to the conceptual diagram of FIG. 1, the outline of the configuration of the therapeutic apparatus X of the present invention is explained.

As shown in FIG. 1, in the therapeutic apparatus X, an airtight chamber 10 where a patient lies, a pump oscillating pressure control unit 20 for controlling a vacuum pump and sound field (vibration) and monitoring the patient, are connected by the hose 15 having various wiring and a resisting pressure function.

The airtight chamber 10 has, for example, a structure such as a small room, which has a predetermined area. In the airtight chamber 10, one patient who is actually treated can be laid. The airtight chamber 10 has the structure where air tightness is high during the time of locking, and internal air pressure can be changed freely without hazard to the patient health. Also, in the airtight chamber 10, the bed 150 of the meshed shape is provided. The bed 150 has width, which the patient can be laid without the patient contacting a wall surface. In addition, speakers/sensors **100-1-100-*n* are provided to surround the bed 150. The wall of the airtight chamber 10** may be a structure, which can easily absorb sound.

When the patient is lying on the bed 150, an operator, who is an attendant or an engineer of the pump oscillating pressure control unit 20, closes the airtight chamber 10 in order to wrap the patient. At that time, hinge 160 or the like is bent, and locked air tight. Otherwise, a structure such as the door of an ordinary room may be sufficient.

Further, when the operator activates the pump oscillating pressure control unit 20, the air pressure inside the airtight chamber 10 will decline slowly below atmospheric pressure, and a low frequency periodical intermittent tone will be emitted from speakers/sensors **100-1-100-*n***, simultaneously.

The pump oscillating pressure control unit 20 displays data by various sensors on a plurality of monitors. The operator can inspect these monitors and can identify the progress of the therapy, etc.

[The Control Configuration of the Therapeutic Apparatus X]

Figure 2:
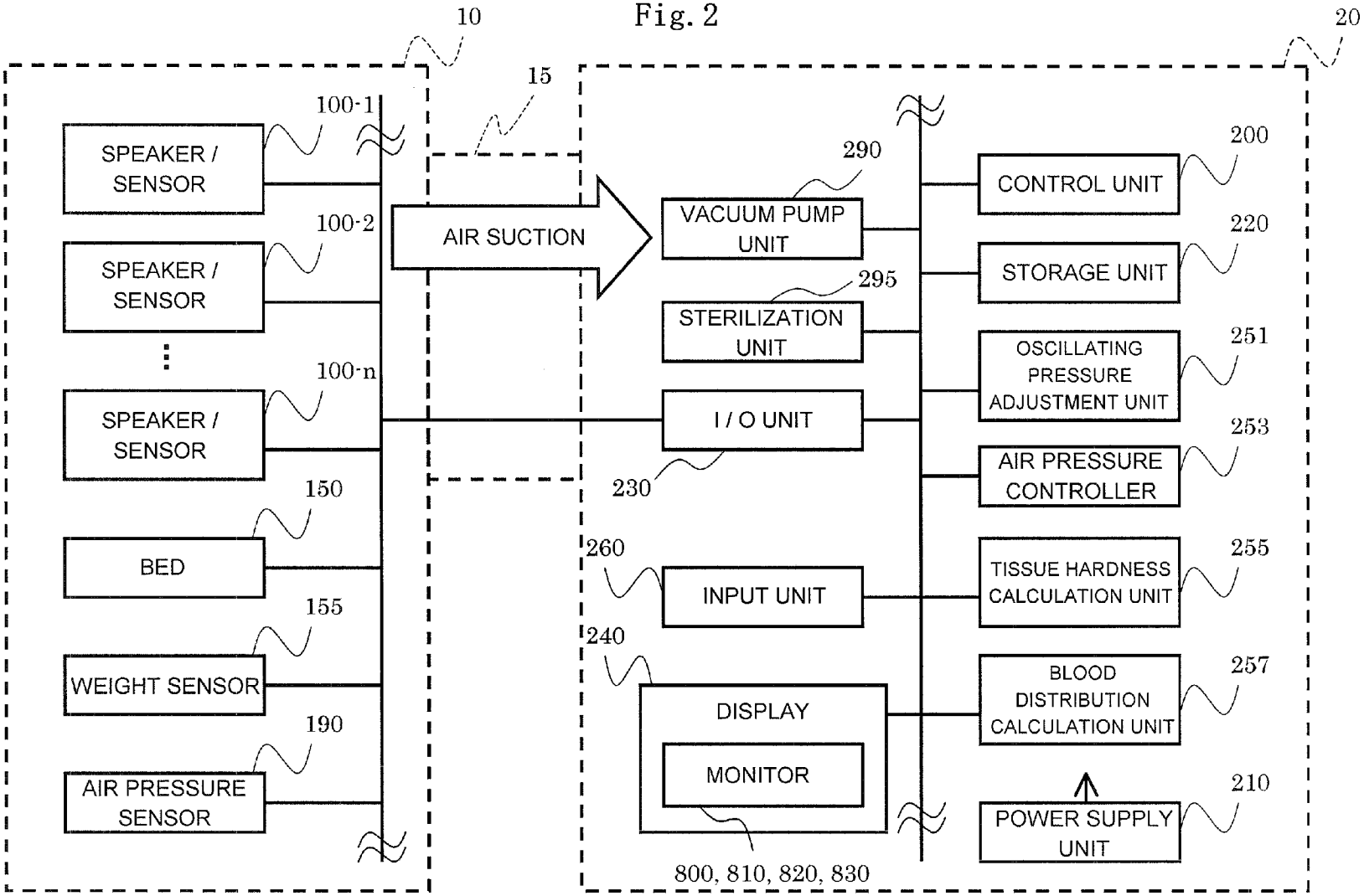
FIG. 2 is a control block diagram of the therapeutic apparatus X related to the first embodiment of the present invention.

Referring to the block diagram of FIG. 2, the control configuration of the therapeutic apparatus X related to the first embodiment of the present invention is explained.

As mentioned above, in the therapeutic apparatus X of this embodiment, the airtight chamber 10 and the pump oscillating pressure control unit 20 are connected with the hose 15.

In the following, configurations of each part of these are explained in more detail.

(Configuration of the Airtight Chamber 10)

The configuration of airtight chamber 10 (negative pressure unit) includes speakers/sensors **100-1-100-*n* (sound wave generating units, sensor units, and oscillating pressure addition units), a bed 150 (a bed, and a sensor unit), a weight sensor 155 (sensor unit), and an air pressure sensor 190**.

The sensors provided in each part are connected on a common bus to the pump oscillating pressure control unit 20 via the hose 15, which includes an optical fiber, various electric cords, and terminal(s), Each of the speakers/sensors **100-1-100-*n* has a sound wave generator, such as a speaker and a piezoelectric element pad, which emits a sound wave towards the patient lain on the bed 150 in the airtight chamber 10** and adds sound pressure (oscillating pressure), and includes an electric wave or an infrared radiating element, and an infrared sensor or a small semiconductor radar element, etc. The sensors detect the state of the body surface of the patient, such as blood pressure, a pulse, body temperature, and oxygen saturation. They are configured as an array-like instrument.

The speakers/sensors **100-1-100-*n* are arranged surrounding the body of the patient. Surrounding the body enables a sound wave to be added to the whole body surface of the patient, and the sensors can check each part of the body. With regard to a sound, which one of speakers/sensors 100-1-100-*n*** generates, a sound of low frequency is emitted as a periodic pulse form, and pressure is put on the patient's body. Therefore, it is preferred to provide a sound wave generator which can emit enough low frequency range by using Helmholtz resonance, etc.

Also, one of the speakers/sensors **100-1-100-*n*** can be provided to observe the vital signs of the patient, such as the pulse, blood pressure, body temperature, and oxygen saturation by non-contact. Further, a sensor that can measure the state of the degree of elasticity or a blood flow for the body surface of the patient without contact can also be provided. These sensors are preferably combined with the sound wave generator.

In addition, the speakers/sensors **100-1-100-*n* may be placed in order surrounding the bed 150, rather than on the wall surface of the airtight chamber 10. In this case, a configuration that each the speaker/sensor 100-1-100-*n* is movable is possible, and thus distance to the patient can be adjusted freely. Alternatively, the structure that the array is adjustable according to physical constitution, etc., of the patient is also possible. Further, the array of speakers/sensors 100-1-100-*n* can be controlled by the control unit 200 in the pump oscillating pressure control unit 20. In addition, a large a number of sound wave generators as possible is better because fine-tuning is enabled according to the shape of the body of the patient. The sensor which obtains the patient's vital sign, etc., can also be provided aside from the sensor for one of the speakers/sensors 100-1-100-*n***.

The bed 150 has, for example, a plurality of frames, and a lot of strings are spread to a horizontal direction and a vertical direction in the inner part of the frame. Thus, the bed has a structure such as meshes of a net. During the therapy, the patient lies on his back on the strings such as meshes of the net. At that time, he or she lies in a position hung by a hammock and may be strapped by a belt, etc.

Because the sound wave is added to the patient's body surface during the therapy, a structure of bed 150, which reduces influence by the sound wave as much as possible, is preferred. On the other hand, while the therapy continues, the body is fixed firmly the bed 150 to prevent a position of the patient from being changed. In addition, during the therapy, the sound wave of an opposite phase can be added to the frame of the bed by a piezoelectric element, etc., to prevent vibration by a sound wave, and vibration can be negated. Accordingly, at the time of therapy, a sound wave can be added to the whole body of the patient in the state of suspension, without a contacting structure that interrupts the sound wave. Also, in the bed 150, electrodes which passes and measures weak current can be provided, and the body fat percentage of each part the body of the patient can be estimated by measuring bioelectricity impedance.

Further, another upper frame structure can be provided on the structure of the frame. Strings can be similarly spread around the inner part of this frame such as meshes of a net, and this upper frame may have a configuration to be adjusted in position. In this case, the patient lain on the bed is fixable by the upper part. In such a configuration, the patient can be wrapped from the upper and lower directions with the strings such as meshes of the net, and he or she can be fixed firmly in the state of suspension.

The weight sensor 155 is a sensor of a scale, which uses a pressure sensor and a mass sensor provided at a hook of the bed 150. By using the weight sensor 155, cardiac beats of the subject can be detected.

The air pressure sensor 190 is a sensor, which measures the air pressure in the airtight chamber 10. For the air pressure sensor 190, a highly precise sensor that can detect the air pressure about a few thousands of hecto-pascal is preferred.

Also, the air pressure sensor 190 notifies an error under the condition that air tightness is not maintained in case that the measured value of this air pressure does not decrease in the time of operating the vacuum pump unit 290.

Also, the air pressure sensor 190 may further be provided with oxygen and a carbon dioxide sensor in order to prevent the oxygen debt of an airtight chamber and the increase in carbon dioxide levels.

In addition to this in the airtight chamber 10, the hinge 160 on the wall surface of the airtight chamber 10 is provided. The hinge 160 is, for example, a hinge that has a configuration to open and close by being moved up and down. To prevent air penetrating from the hinge 160, the structure of hinge 160 itself is also sealed, enabled to rotate, and provided with a sensor that detects the locked state certainly. Further, a sensor, which can confirm that the patient is laying in the right position on the bed, can be provided. In addition, inside the airtight chamber 10, an opening-and-closing button, etc., which opens and closes the airtight chamber 10 from an inner side to unlock, etc., is provided.

Also, the therapeutic apparatus X can also be used for a medical treatment of infection. In such case, in the airtight chamber 10, sterilization equipment that sterilizes the inner part of an airtight chamber for every use of the medical treatment, and a medical air cleaner can also be provided.

A black light can be used as sterilization equipment that sterilizes the inner part of the airtight chamber. The black light can sterilize floating bacteria, adhesion bacteria, etc., inside the room by ultraviolet radiation. Also, a publicly known ozone generating device, a device by using electric discharge, etc., can also be used as the sterilization equipment.

Also, for the air cleaner, for example, a publicly known device can be used. Thereby, disease-causing microorganisms can be sterilized completely by heating and burning in the air, and thus leaking of the disease causing microorganisms to outside can be prevented.

Further, in addition to sterilize the inside of the airtight chamber 10 after treating the infection, a configuration in which the patient is also disinfected and sterilized after treating is possible.

Also, in addition to the airtight chamber 10, a separate space, which isolates the patient to prohibit external contact for a prescribed period after therapy, may be provided.

(Configuration of the Pump Oscillating Pressure Control Unit 20)

The pump oscillating pressure control unit 20 includes a control unit 200 (an adjustment device, a controller), a power supply unit 210, and a storage unit 220, an I/O unit 230, a display 240 (monitor display part), and an oscillating pressure adjustment unit 251 (an oscillating pressure adjustment device, sound pressure adjustment device), an air pressure controller 253 (air pressure adjustment device), and a tissue hardness calculation unit 255 (tissue hardening calculating device), a blood distribution calculation unit 257 (blood distribution calculating device), an input unit 260 (input device), and a vacuum pump unit 290 (negative pressure device) and a sterilization unit 295 (sterilization device), and each part is connected by common bus.

The control units 200 are CPU (central processing unit), MPU (micro processing unit), etc., to control each part and perform air pressure and sound field control processing in accordance with a therapy program memorized in the storage unit 220 by using hardware resources.

The power supply unit 210 is a switching power supply, etc., and supplies electric power to each part. The power supply unit 210 has AC power receptacle, etc., which are not illustrated, and electric power required for each part is supplied by using the source of home electric power for the ordinary 100V/110V or the source of industrial electric power for 200V, etc.

The storage unit 220 is RAM (random access memory), ROM (read-only memory), a flash memory, HDD (hard disk drive), etc. The storage unit 220 memorizes various data, such as a value from each sensor, monitor display image, and a program and data which the control unit 200 executes and uses, etc.

The I/O unit 230 is a part provided with various I/O interfaces, such as a serial, a parallel, and USB (universal serial bus), and inputs the value from each sensor. In addition, the I/O unit 230 is also provided with the function which performs the A/D conversion of the value from a sensor, or supplies electric power to each sensor, an infrared diode, an electric wave generating element, etc. Further, the I/O unit 230 adds high frequency current to the electrodes on the bed 150 and is also provided with the function of measuring bioelectricity impedance.

The display 240 is a LCD (liquid crystal display) panel, an organic EL (electro-luminescence) panel, a small printer, etc., and can identify monitor values, etc., which are described later.

The oscillating pressure adjustment unit 251 is a part, which adjusts vibration added to the patient based on the value from each sensor. According to this embodiment, the oscillating pressure adjustment unit 251 functions as a sound pressure controller which performs calculation and controls to adjust the sound wave emitted from each of speakers/sensors **100-1-100-*n*** for the therapy.

The air pressure controller 253 is a part, which adjusts the output of the vacuum pump unit 290 and performs the calculation and control for decompression for therapy based on weight of the patient, etc., and the value of the air pressure sensor 190, etc.

The tissue hardness calculation unit 255 is a part which performs calculation to determine a tissue hardness for each part of the body of the patient based on the values from each sensor, such as the speaker/sensor **100-1-100-*n*. It also makes a monitor image. Also, the tissue hardness calculation unit 255** may perform calculation which determines for the degree of tissue hardening based on measurement data by microwave, information analysis data of a motion of the body surface during the therapy by the thermometer, etc.

The blood distribution calculation unit 257 is a part which performs calculation to determine the blood distribution about each part of body of the patient based on the value from each sensor, such as the speaker/sensor **100-1-100-*n***. It also prepares a monitor image.

The input unit 260 is a part provided with various buttons, such as ten keys. It detects the input of the operator for various controls of the therapeutic apparatus X. Also, the display 240 may be provided as a touch panel integrated with the input unit 260.

The vacuum pump unit 290 can be a conventional vacuum pump. Also, the vacuum pump unit 290 is provided with the function to freshen air of the sealed airtight chamber 10 while decompressing is performed. Further, the vacuum pump unit 290 can provide a filter, etc., which raise oxygenic partial pressure, and can also provide a function, which supplies air rich in oxygen to the airtight chamber 10.

The sterilization unit 295 is a sterilization device of the pathogenic bacteria including sterilization equipment for removing a pathogenic organism by using a ultraviolet light, ozone or other gas, atomizer of alcohol, etc., and a filter by using HEPA, activated carbon, etc.

In addition, the oscillating pressure adjustment unit 251, the air pressure controller 253, the tissue hardness calculation unit 255, and the blood distribution calculation unit 257 are feasible by using hardware resources as the control unit 200 runs the program memorized in the storage unit 220.

[Air Pressure and Sound Field Control Processing of the Therapeutic Apparatus X]

Figure 3:
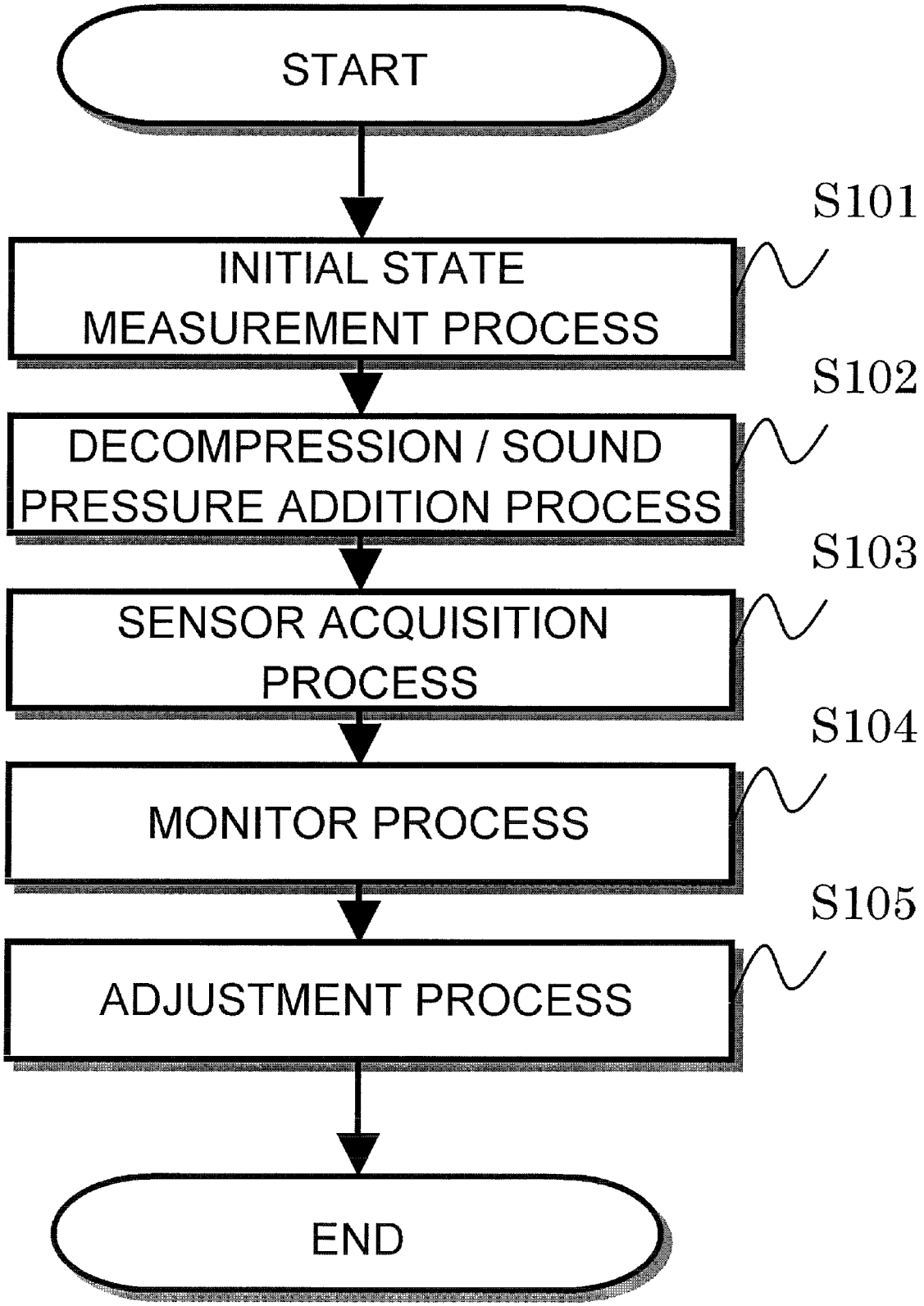
FIG. 3 is a flow chart of the air pressure and sound field control processing related to the first embodiment of the present invention.

Then, with respect to FIG. 3, the procedure of the air pressure and sound field control processing which treats fatigue by the therapeutic apparatus X of this embodiment is explained.

As a procedure of the practical therapy in the therapeutic apparatus X is explained as follows:

At first, in Step S101, an initial state measurement process is performed. In this process, a patient lies in the apparatus, measures the hardness of the body surface for a resting period, and sets this value as the standard value (hardness 0).

Then, in Step S102, a decompression/sound pressure addition process is performed. Air pressure is gradually reduced lower than atmospheric pressure, and, simultaneously, the vibration by a sound wave is added to the entire body surface. In this step, the sound wave of an equivalent pressure is added to the entire body surface for the first measurement of the hardness of the body surface.

Then, in Step S103, sensor acquisition process is performed. In this process, the hardness (hardness i) of the body surface is measured. Also in this process, (hardness 0) is subtracted from (hardness and distribution and hardness of stiffness of the entire body surface are measured. Also, based on the obtained data, distribution and strength of the sound wave added to the body surface are adjusted, and the vibration by the sound wave is added by performing inclination distribution as applying the strongest sound wave to the most hardness part of stiffness.

Then, in Step S104, monitor process is performed. In this process, the hardness (hardness of the body surface is measured during the state of applying the oscillating pressure to the body surface by performing the inclination distribution according to the state of stiffness. The (hardness 0) is subtracted from the (hardness iii) and distribution and hardness of stiffness on the entire body surface are measured in the similar manner as Step S103. In this case, when distortion occurs in measured values as compared with the value acquired by S103, the measured hardness is modified. This process is explained later.

Then, in Step S105, adjustment process is performed. Specifically, distribution and strength of the sound wave being applied to the body surface are adjusted again according to the measured value in Step S5104. After that, measuring in real time for the transition of the state of stiffness of the body surface in a similar manner the oscillating pressure continues to be applied at a modified suitable distribution and strength. Then, the therapy is finished after applying oscillating pressure for a definite period of time.

Referring to FIG. 3, each step is explained in detail in the following.

(Step S101)

Firstly, in beginning the therapy by the therapeutic apparatus X, the control unit 200 of the pump oscillating pressure control unit 20 performs an initial state measurement process that measures initial state of the patient. In the processing unit X of this embodiment, the condition of the patient before therapy is important and is measured.

In this process, at first, the control unit 200 measures cardiac beats.

Then, the control unit 200 measures the influence of clothes.

After the patient lies in the airtight chamber 10 with clothes, the control unit 200 can measure the influence of the clothes by irradiating the sound for measurement from speakers/sensors **100-1-100-*n*** and obtaining the reflected sound by a microphone etc. This measurement result is used as a parameter in time of calculating each part.

In addition, the storage unit 220 can previously memorize the information on clothes.

After performing these measurements, the operator locks the airtight chamber 10 in the airtight state, confirms the condition of the patient by using the display 240 of the pump oscillating pressure control unit 20, and pushes the "start" button.

Accordingly, the pump oscillating pressure control unit 20 specifically starts air pressure and sound field control.

(Step S102)

Then, the control unit 200 of the pump oscillating pressure control unit 20 performs decompression/oscillating pressure addition process.

In detail, the control unit 200 operates the vacuum pump unit 290 and decompresses the inside of the airtight room slowly. Also, the sound field (oscillating pressure) of an intermittent tone is applied to the entire body surface with decompression, simultaneously.

Performing these processes is needed to be at substantially the same time. That is, decompression and pressurization (application of the oscillating pressure) by a sound wave suppresses the burden of the body of the patient by lowering air pressure, and the risk of causing elevation of cardiac beats rate, etc., can be lowered. Also, by comparing the case without lowering the air pressure and with adding only the oscillating pressure, it can prevent the burden on the bodies, such as occurring excessive elevation of blood pressure.

Here, the details of the sound wave added to the entire body surface simultaneously with decompression are explained.

In the decompression/sound pressure addition process, the control unit 200 transmits a sound signal to speakers/sensors **100-1-100-*n* by using the I/O unit 230. Accordingly, sound waves are emitted from speakers/sensors 100-1-100-*n***, and sound pressure (oscillating pressure) is applied to the body of the patient.

This sound is an intermittent tone and gives sound which repeats the sound wave of specific frequency intermittently in a rhythm at equal intervals to the body surface. In the time of the therapy, frequency or the length of the interval of the rhythm can be set up freely, and thus the most suitable sound frequency and rhythm according to the condition of the patient can be applied. The patient feels a stimulation on the body surface, and he or she will hear a sound, such as bam, bam, bam, . . . , which sounds like to beats by a bass drum.

<Relationship between Pressure and Oscillating Pressure>

Here, as refer to FIG. 4A-FIG. 4D, in the time the pressure in the airtight chamber 10 is lowered from atmospheric pressure and oscillating pressure addition is performed, the relationship between pressure in the living body, the pressure in the airtight chamber 10, and the oscillating pressure is explained in detail.

Firstly, the relationship between air pressure and a human body is described, and then the principle of the therapeutic apparatus X is explained.

Figure 4A:
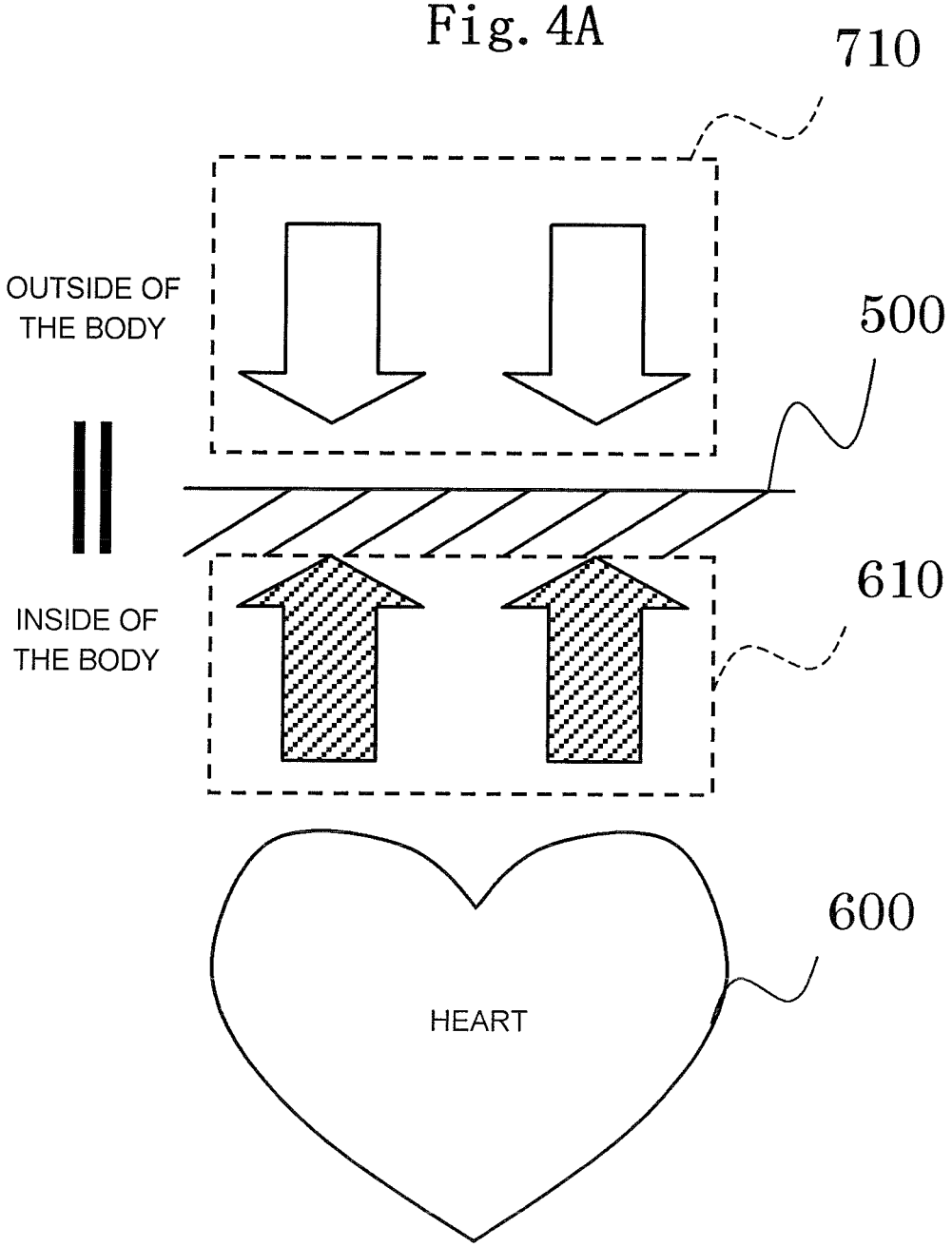
FIG. 4A is a conceptual diagram of addition of the oscillating pressure by the sound wave related to the first embodiment of the present invention.

Referring to FIG. 4A, a body is subjected to atmospheric pressure without being conscious of the pressure. Namely, in the every part of the body surface, pressure having direction from outside to inside is applied by atmospheric pressure. In FIG. 4A, the atmospheric pressure outside of the body is shown as air pressure 710, and the body surface is shown as skin 500.

On the other hand, the heart and arterial system in the body have sent out blood from the inner part of body (heart 600) toward peripheral tissue by the pumping action. The pressure pushed out the blood flow from the inner part of body to the body surface by the pumping action is the force opposite to the pressure of the atmospheric pressure. Also, it is considered that the force by the pumping action of the heart or an arterial system is almost equal to blood pressure. The pressure of this intracorporeal force is shown as a blood pressure 610.

Usually, the two forces, air pressure 710 and blood pressure 610, balance.

Figure 4B:
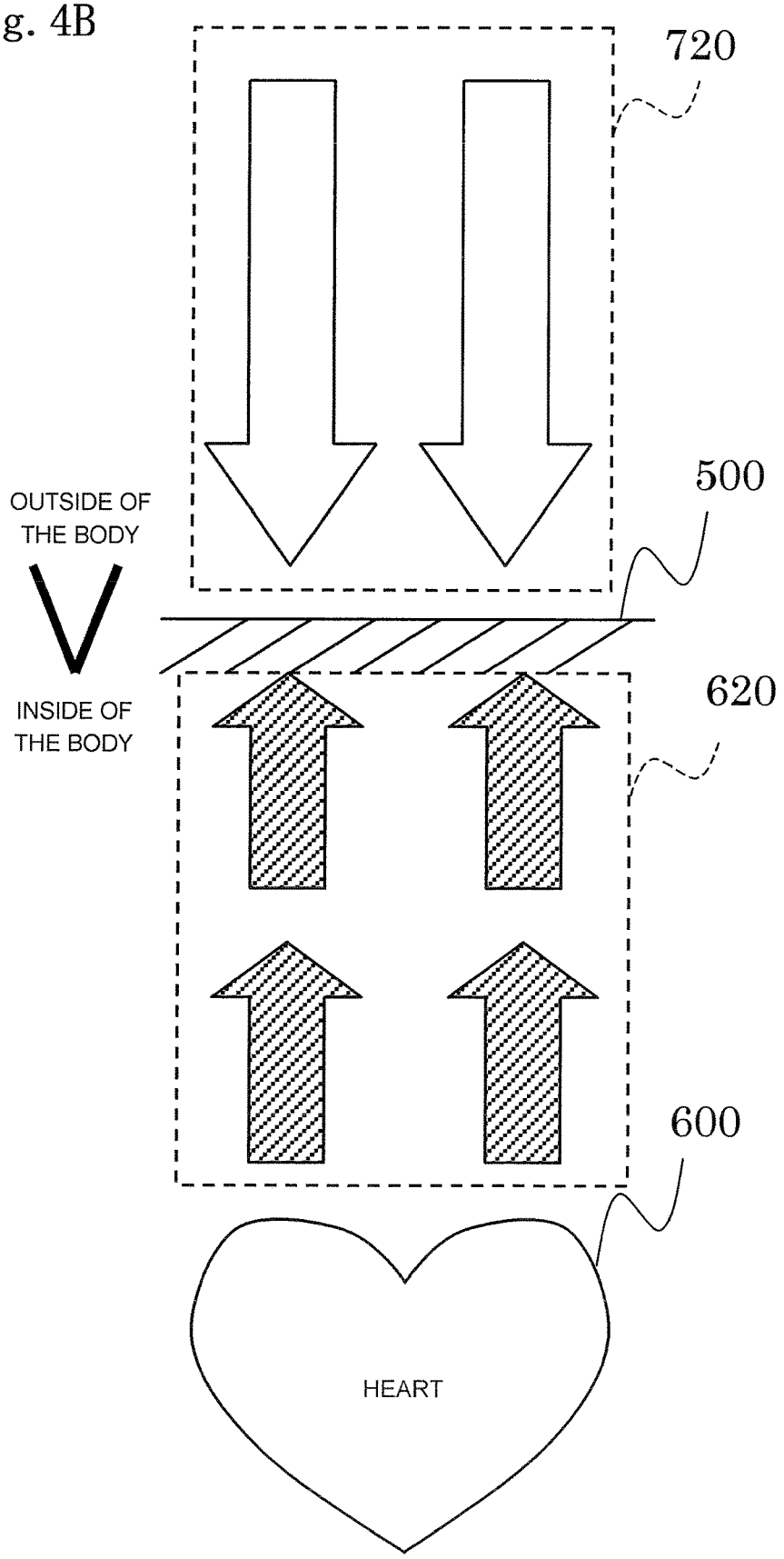
FIG. 4B is a conceptual diagram of addition of the oscillating pressure by the sound wave related to the first embodiment of the present invention.

Then, referring to FIG. 4B, the case that air pressure rises is considered.

For example, when a human goes underwater, the bodily external pressure rises by water pressure. Namely, the force of pushing the body surface from the outside to the inner side increases by water pressure. This force to push is shown in the water pressure 720. Since the force of going from the outside to the inner part by water pressure is larger, this force becomes force that compresses internal air, and thus balance is maintained with decreasing internal volume.

That is, since the pressure added to the body surface increases by the atmospheric pressure from the outside, blood pressure is raised to maintain and to balance for the pressure. This is shown as blood pressure 620.

Figure 4C:
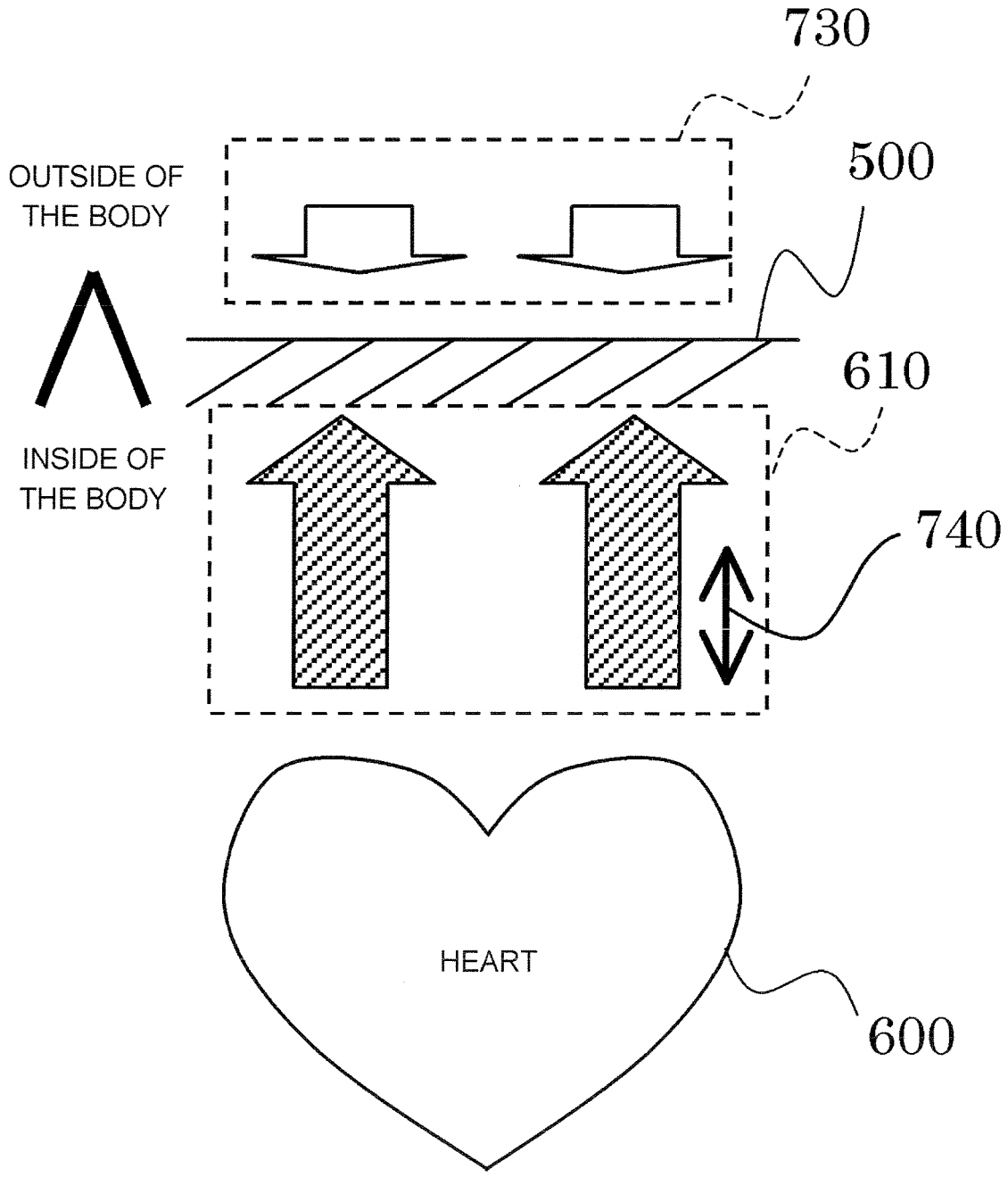
FIG. 4C is a conceptual diagram of addition of the oscillating pressure by the sound wave related to the first embodiment of the present invention.

Then, as refer to FIG. 4C, the case that air pressure decrease is considered.

For example, open-air pressure declines at a height. This atmospheric pressure is shown as air pressure 730.

In this case, since atmospheric pressure declines to the contrary as FIG. 4B, the force from the outside to the inner side added on the surface of the body decreases. If the blood pressure at this time is assumed not different from the blood pressure 610 of FIG. 4A, the force of the difference of the air pressure 730 and the blood pressure 610 will work as the difference pressure 740, which is outward force. That is, when atmospheric pressure declines, the pressure in the direction to expand the entire body works.

As figuratively compared to a balloon for example, the balloon will expand when the balloon is brought to the room where air pressure is low. This is because the force of pushing the surface for the balloon from inside to the outside by air inside the balloon becomes larger than the force of pushing the surface for the balloon from outside to the inside by atmospheric pressure.

As for a human body, it does not expand as like the balloon, but under the environment where air pressure is low, difference pressure 740, which is an outward force to expand body, is added continuously.

As mentioned above, in case of raising the external pressure, the living body has to raise blood pressure to maintain and balance for it. Then, the elevation of the external pressure becomes stress, which raises blood pressure for the living body.

Similarly, in case of declining the air pressure, the living body will have pressure to reduce blood pressure. Therefore, the living body makes the cardiac output increase in order that blood pressure is not reduced excessively and raises haemal circulation volume to maintain blood pressure. That is, in case of lowering the air pressure, as a result, the burden is added to the body as similar to increase the vascular resistance of the entire body, and thus the cardiac output increases.

Thus, this is one reason that increases in the cardiac output makes the burden on the body larger under the environment of lowering air pressure.

Figure 4D:
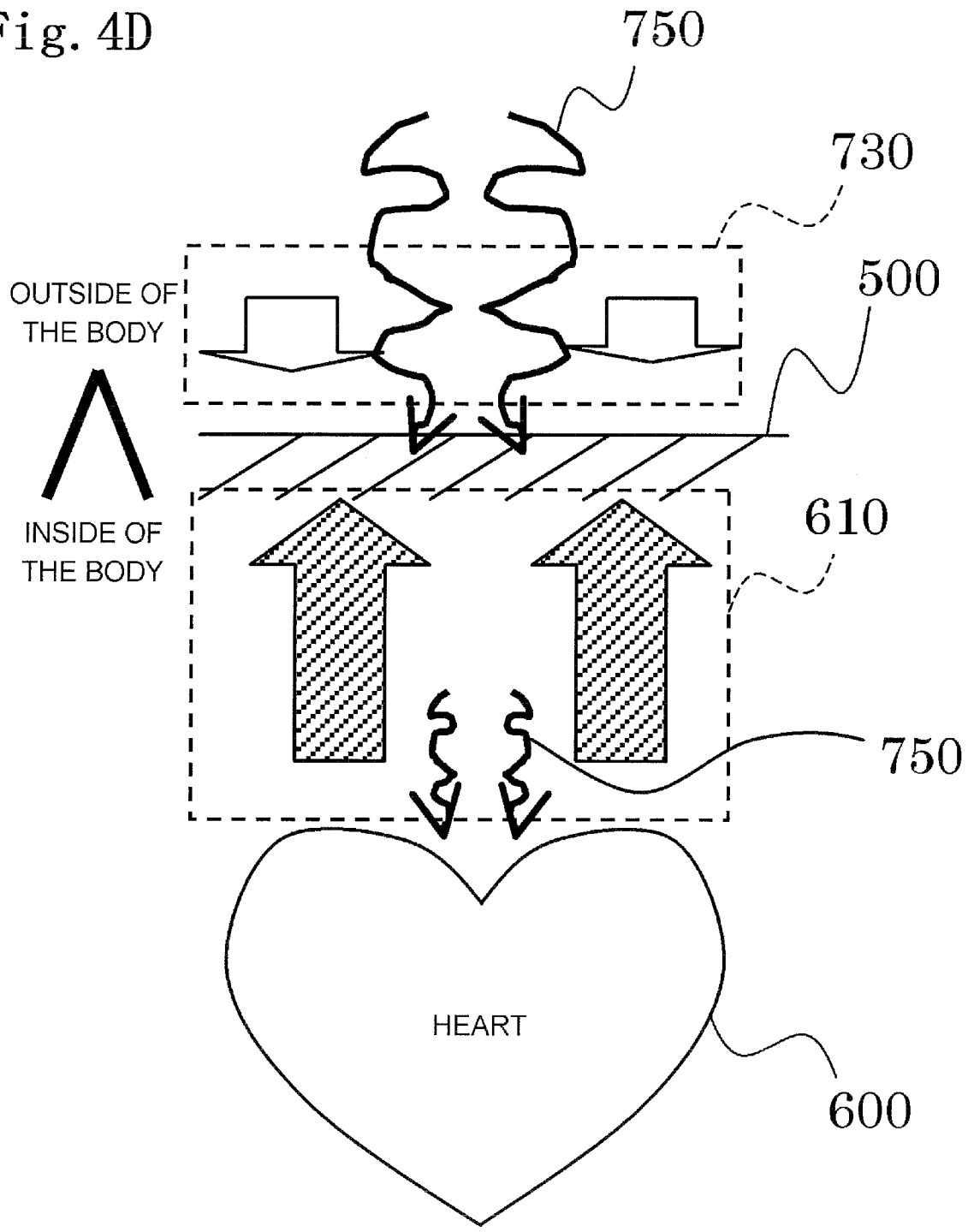
FIG. 4D is a conceptual diagram of addition of the oscillating pressure by the sound wave related to the first embodiment of the present invention.

Based on the above, with reference to FIG. 4D, the effect by adding vibration to the body surface with a sound wave is explained. In this situation, the air pressure in the airtight chamber 10 is lower than standard atmospheric pressure, and the burden is generally placed on the human body.

In order to reduce the burden of the body accompanying lowered air pressure, during therapy by using the therapeutic apparatus X, the air pressure is reduced below standard atmospheric pressure, and the vibration by a sound wave is applied to the entire body surface at the same time. Accordingly, the intermittent force by oscillating pressure works in the direction from the body surface to the inner part. This effect is considered below.

60 to 70% of the human body consists of body fluid, and the body fluid is classified to extracellular fluid and intracellular fluid. The intracellular fluid is considered as almost static, and the extracellular fluid circulates through the body as tissue fluid, blood, lymph, etc. In other words, the body contains two types of fluids. One type fluid is static as intracellular fluid, and the other type fluid has a vector of the flow going from the inner part of body to the body surface with circulating by heart, artery, etc., in the inner part. However, the intracellular fluid has the quantity more than double as compared with the extracellular fluid. Thus, expediently, these are summarized and regarded as quiescent fluid, which is trapped in the entire body.

Here, the case is considered that the oscillating pressure 750 by the sound wave is applied to the entire body surface of the patient at the time of therapy with the therapeutic apparatus X.

The fluid by the network of the heart and the arterial system inside body, that is, the circulatory system has a vector of a flow in the direction from the inner part to the surface of the body as mentioned above. This is occurred by the pulsation of the heart and the arterial system.

On the other hand, vibration added to the body surface is, by Pascal's law, "When pressure is applied to confined fluid, increased pressure is transmitted in all the directions of fluid in the same strength," transmitted equally inside the body, which is the confined and quiescent fluid. Vibration by the sound wave transmitted to the circulatory system, which is the heart and the arterial system, vibrates the heart, the artery, themselves, etc., and it is considered that the arterial wall, etc., may be pushed inside intermittently. Because this work has the similar function of pulsation, since the vibration by the sound wave works well, it serves to reinforce and assist arterial and cardiac pulsation. As a result, the function in which the heart and the arterial system send out blood is improved, haemal circulation volume increases, and the force that the blood flow ongoing from the heart to the body surface is strengthened.

In this way, by adding vibration by oscillating pressure to the body surface, the pumping ability by the heart and the arterial system can be assisted, and the outflow of the blood from the heart can be raised.

Therefore, in the time of therapy, by reducing air pressure and by applying vibration by the oscillating pressure of the suitable loudness to the body surface at the same time, an increase of a burden for the heart and the arterial system due to lowered air pressure can be compensated with the auxiliary effect of the cardiovascular pumping action by adding vibration to the body surface. Namely, when this apparatus reduces air pressure and applies vibration by a suitable oscillating pressure for the body surface, simultaneously, difference between air pressure and blood pressure can be enlarged without risking the burden to the body. Thereby, the filtration function of the skin can be accelerated and excretion of the wastes from the skin can be promoted.

(Step S103)

Then, the control unit 200 of the pump oscillating pressure control unit 20 performs sensor information acquisition process.

In this sensor information acquisition process, required sensor information to treat effectively and to treat safely, simultaneously, is obtained. The control unit 200 controls with this sensor information, thereby safe therapy is realizable.

In practical therapy, in the state where the patient is laid in the apparatus, the processes of reducing air pressure and applying oscillating pressure to the entire body surface simultaneously is certainly performed at the same attitude in order to avoid the excessive burden on the body. With regard to the air pressure, the air pressure is gradually reduced from standard atmospheric pressure. Also with regard to the oscillating pressure, small oscillating pressure is applied firstly, and then larger oscillating pressure is added gradually. When the value of air pressure and oscillating pressure reaches the fittest value, these values are fixed and treatment for a predetermined period is performed. As described below, in the treatment time, the strength of an applied sound wave is varied according to the state of the part of the body. Also, in these processes, vital signs, such as blood pressure and pulse, are monitored in real time by non-contact monitor, and the air pressure and the oscillating pressure to apply are adjusted so that a burden may not be added to the body. These adjustments as mentioned above are performed automatically by computer control based on a database.

[Measurement of the Position of the Patient Inside the Apparatus, and the Irradiation Method of the Sound Wave]

As mentioned above, in the therapeutic apparatus X, the sensor, such as a thermometer by using the infrared sensor, which can detect the infrared rays emitted from a human body, etc., may also be provided in the speakers/sensors **100-1-100-*n***, respectively. These thermometers can be used to measure the position of the patient in the apparatus accurately during the therapy.

Accordingly, body surface temperature of the patient is measured from some directions with a plurality of thermometers, the temperature variation in the therapy space is grasped in three dimensions, and the position of the patient in the space can be accurately measured from the temperature variation of the body temperature of the patient. Based on that, the control unit 200 determines an accurate distance from each speaker/sensor **100-1-100-*n* to the body surface and calculates the strength of the sound pressure (oscillating pressure) of each speaker. In this case, the strength of the oscillating pressure added per unit volume of the body surface is determined based the number of speakers/sensors 100-1-100-*n*. Here, with regard to the strength of oscillating pressure, the strength of a perpendicular direction to the body surface is evaluated. In addition, for applying the oscillating pressure to the body surface accurately, the strength of the oscillating pressure given to the patient can be adjusted by using a principle of an active noise controller which irradiates an opposite phase sound wave with calculating the transition of the phase of the sound wave. Accordingly, the error of measurement as result by an echo of the sound wave, cardiac pulsation, or sudden motion of the patient (hereinafter, it calls an "artifact") can be canceled. This cancellation of the artifact is described in detail later. Further, by using the principle of the active noise controller, the phase of the sound wave is negated, or, conversely, is stacked up and reinforced. Thus, the difference in the strength of the sound wave can be emphasized. In this case, the strength of the sound wave after being reflected in the body surface may also be adjusted in the time to adjust the strength of the sound wave added to the body surface from the speakers/sensors 100-1-100-*n***. In addition, the sound wave that reaches the ear can be negated and reduced in volume, and a bad influence to hearing acuity can also be prevented.

As summarized, in order to pressurize the body surface of the patient by the sound wave, speakers/sensors **100-1-100-*n* are installed surrounding the patient who lays in the apparatus. Various sensors are also attached to the same position, and the control unit 200 of the pump oscillating pressure control unit 20 performs sensor acquisition process by using the sensors. Some information can be acquired from these sensors (This process is described later). The information includes strength and distribution of the oscillating pressure added to the body of the patient, a transition of the elasticity of the body surface, and a transition of the blood flow of the body surface. Also, the information of the patient including blood pressure, a pulse, body temperature, oxygen saturation, etc., can be acquired during the therapy. The control unit 200 memorizes the value obtained from each sensor to the storage unit 220 via the I/O unit 230**.

(Step S104)

Then, the control unit 200 of the pump oscillating pressure control unit 20 performs a monitor process. From the value of each sensor memorized to the storage unit 220, at least three monitors 810, 820, and 830 are drawn to the display 240 (as refer to FIG. 5).

[About the Various Monitors]

The monitors 800, 810, 820, and 830 can display states of the body surface of the patient in real time. Distribution of the oscillating pressure can be adjusted as the state.

The monitor 800 is a part, which reports a variety of information to an operator (hereinafter, calls a "monitor"). The monitor 800 includes a program, which measures various vital signs, and indicative data displayed on the display 240, etc., is memorized in the storage unit 220, and achieved by the control unit 200 with hardware resources.

The monitor 810 includes a program which measures distribution and strength of the oscillating pressure applied to the body surface of the patient and indicative data to a display, etc. The monitor 810 is a monitor configured with an oscillating pressure adjustment unit 251 and an air pressure controller 253.

The monitor 820 is a monitor, which measures a transition (state of stiffness) of the elasticity a patient's body surface. The monitor 810 is configured with the tissue hardness calculation unit 255.

The monitor 830 is a monitor, which measures state of the blood flow of the body surface of the patient. The monitor 830 is configured with the blood distribution calculation unit 257.

In addition, in the therapeutic apparatus X, the influence of gravity added to the body during therapy may be required to be calculated, and an adjustment may be needed. Performance of this specific adjustment is described later in detail.

<Monitor 800>

The monitor 800 is a monitor of vital signs, such as cardiac beats rate, blood pressure, body temperature, and a breathing rate, etc., which are vital signs of the patient. The monitor 800 measures and displays the vital signs continuously within the progress of therapy. As mentioned above, these vital signs may be measured as in non-contacted state or contacted state by the various sensors of the speakers/sensors **100-1-100-*n*, etc. The monitor 800 accumulates the data for every therapy, and puts in a database in the storage unit 220. The database is used for the determination in the case of the control of each part in various processes of therapy by control unit 200**, etc.

<Monitor 810>

Figure 5:
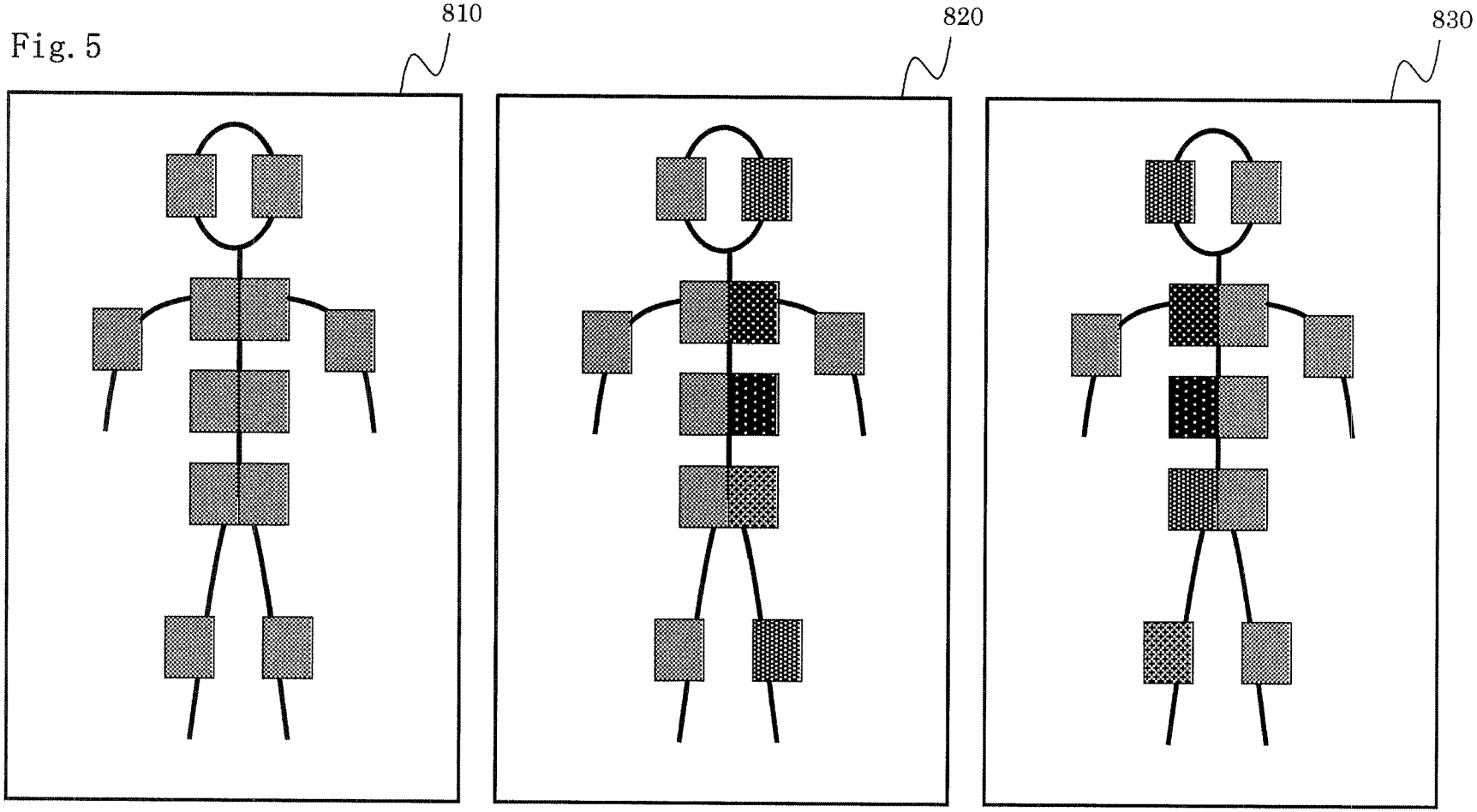
FIG. 5 is a conceptual diagram of monitors related to the first embodiment of the present invention.

The monitor 810 in FIG. 5 is a monitor that measures the distribution and the strength of the oscillating pressure applied to the body surface of the patient. The monitor 810 watches the range and the strength of the oscillating pressure added to the body surface during the therapy. The control unit 200 displays the information on the oscillating pressure outputted from each speaker/sensor **100-1-100-*n* on the display 240 by the monitor 810**.

In this case, the control unit 200 displays the result calculated by the oscillating pressure adjustment unit 251 based on information including the distance from speakers/sensors **100-1-100-*n* to the body surface, a sound intensity of a speaker, a number of speakers, etc. It can be displayed in real time by calculating the oscillating pressure adjustment unit 251 that provides high-speed calculation ability. Accordingly, the attendant can understand how the oscillating pressure to the body surface is added. In addition, the control unit 200 can adjust distribution of oscillating pressure in conjunction with each speaker/sensor 100-1-100**-*n*.

The monitor 810 displays a total amount of energy of the oscillating pressure applied to the body surface by a setting.

In this case, the control unit 200 calculates a total amount of energy of the oscillating pressure applied at right angles to the body surface of the patient during the therapy, and the result of the calculation for the entire body surface is displayed. As the total amount of energy of this oscillating pressure, the control unit 200 can calculate the quantity of prescribed periods, such as a total amount after starting the therapy, and a total amount of a day. Accordingly, the attendant can understand information, including distribution and deviation of the pressure applied to the body surface, etc., in the case of therapy.

Namely, this information can perform safe reservation to prevent an excessive deviation of addition of oscillating pressure. This information can be used in the situation such as the case of cervical therapy in which the total amount of the energy of the oscillating pressure applied to the neck is kept higher than other parts for safety, as described below, etc.

<Monitor 820>

The monitor 820 in FIG. 5 is a monitor, which shows the rate of change in the hardness of the body surface in order to evaluate the level of stiffness. That is, the monitor 820 is a monitor, which measures change (state of stiffness) of the elasticity of the body surface of the patient.

Specifically, the control unit 200 calculates the rate of change in the hardness of the body surface by using the tissue hardness calculation unit 255 based on the data obtained from the speakers/sensors 100-1-100-*n*.

The control unit 200 can measure the degree of hardening of the skin by using the tissue hardness calculation unit 255. The measuring method of elastic property with the sound wave, which is known art (see JP2007-192801A, the WO No. 2007-034802, etc.), can be used for the measurement.

In the case of therapy, the hardness (elasticity) of the body surface of a resting period is measured for each speaker/sensor 100-1-100-*n*. Then, the hardness of the body surface in the state while oscillating pressure being applied is measured. The part where the hardness is changed (stiffness) can be extracted by subtracting the former from the latter.

For this measurement, the control unit 200 can use an instrument such as microwave radar (as refer to JP2008-99849A, JP2012-57962A, etc.). The control unit 200 measures hardness and rate of change in the hardness of the body surface during the therapy. For the measurement, the control unit 200 can analyze the applied pressure with uniting motion capture data in three dimensions by adding the oscillating pressure to the body surface. In detail, the control unit 200 measures a distance displaced by the body surface toward the bodily inner side by using microwave at the time of applying the oscillating pressure to a body surface. Then, the control unit 200 analyzes the distance as compared with the magnitude of the oscillating pressure applied to the body surface. Consequently, the hardness per unit volume and the rate of change in the hardness can be measured.

Further, for the measurement, the control unit 200 may use a plurality of thermometers (as refer to the JP2012-57962A, etc.). By using them, the control unit 200 can obtain the motion capture data in three dimensions including added oscillating pressure to the body surface under therapy. The control unit 200 may detect distance in which the body is displaced from the body surface in the similar manner. The control unit 200 can also measure the hardness of the body surface and the rate of change in the hardness by the magnitude of the pressure applied to the body surface. In this case, by analyzing the information on the plurality of thermometers, a motion of the body surface can be captured accurately. That is, the hardness of the body surface can be measured from the motion of the body surface in the case of applying oscillating pressure, etc.

The control unit 200 draws the part where the hardness is changed to the display 240, such as the monitor 820 in FIG. 5. The rate of change in the hardness can be displayed in real time.

By the monitor 820, an adjustment for applying the strong oscillating pressure to a part that has a lot of stiffness by inclination distribution is ensured. Consequently, efficient and safe therapy can be performed.

<Monitor 830>

In the monitor 830 in FIG. 5, the state of the blood flow in the body surface of the patient is obtained. In other words, the monitor 830 is a monitor, which measures the state of the blood flow in the body surface of the patient.

By the monitor 830, the monitor 820 can be compensated, and safer therapy can be performed.

The monitor 830 can measure directly the state of the blood flow on the body surface of the patient. In the case of measurement, the monitor 830 is not subject to the influence of a function of autonomic nerves, which may be occurring in the monitor 820. Thus, accurate evaluation can be achieved.

Therefore, for the therapeutic apparatus X, the therapy can be carried out more safely by using the monitor 820 in combination with the monitor 830. That is, the monitor 830 can be used as a monitor for compensating the monitor 820. Thus, if the monitor 820 does not function normally and there is a possibility of an unsuitable oscillating pressure being applied to the body surface in the treatment, the monitor 830 can detect them and can fix the therapeutic method.

The monitor 830 performs the following measurement.

(a) Measure the rate of change of the blood flow volume per unit time of the entire body surface of the patient.

(b) Measure change of the difference for the blood flow volume of each bodily part accompanying the therapy.

In (a), the monitor 830 measures the absolute value of the blood flow volume on the body surface of the patient during the time before the therapy and within the therapy. Then, based on that, the monitor 830 measures the rate of change of the blood flow volume per unit time on the entire body surface of the patient. When the therapy is performed appropriately, it is considered that the blood flow volume on the body surface increases with the therapy even if there is a difference in the level in each part. Thus, the rate of change of the blood flow volume per unit time should be plus in this case. In a contrasting situation, if there is a part where the rate of change becomes minus, it can be estimated that unsuitable therapy is performed. In that case, correction of therapy is required, and thus warning, etc., are displayed on the display 240.

However, for example, the patient whose imbalance of blood flow volume is remarkable before the therapy may recover balance of the blood flow accompanying the therapy. In this case, when blood flow of the part where blood flow volume has been lowered is improved, the rate of change of the blood flow can be minus relatively in the part, which had large blood flow volume from the beginning. Even in case that therapy is performed appropriately, a part where the rate of change of the blood flow volume is temporarily minus may occur depending on the case. Also in these cases, the monitor 830 can display warnings on the display 240.

As (b), the monitor 830 measures change of the blood flow volume of each part of the body. Here, as stated previously, in the therapy by using the therapeutic apparatus X, the strength of the oscillating pressure applied to the body surface is performed by inclination distribution according to the strength of stiffness. That means, a stronger oscillating pressure is applied to the stronger part of stiffness where the blood flow becomes worse. Thus, a therapeutic effect becomes higher and the improvement factor of the blood flow also becomes larger for the stronger part of stiffness. As a result, it is presumed that the difference of the level of stiffness in the whole body and the difference of blood flow volume are gradually reduced in the progress of the therapy. Therefore, if the difference of blood flow volume all over the body shrinks with the progress of the therapy, it will be judged that suitable therapy is performed. Conversely, if there is a part where the difference of blood flow volume increases, a possibility that the therapy is performed unsuitably may be considered.

Each of the blood flow volumes on the body surface are measured, and the largest part of blood flow volume among these is specified as reference A, and the blood flow volume a, b, and c . . . of other parts relative to A are determined. In case that suitable therapy is performed, in all the parts, the difference of blood flow volume with A is reduced with the progress of therapy. Thus, the relative blood flow volume a, b, and c . . . is considered to increase altogether, although there is a difference in the level. Therefore, if relative sequential rate-of-change of blood flow volume of each bodily part a', b', and c' . . . to A is measured, it is considered that all are plus. In contrast, since there is a part that is minus, it is considered that the difference of a blood flow with A is expanded with the progress of therapy in the part. In that case, a possibility that unsuitable therapy is performed is considered, and thus the monitor 830 displays warning on the display 240.

As explained more specifically, the monitor 830 in FIG. 5 is a monitor for acquiring the information of the blood flow and can display the state of the blood flow of the entire body surface in real time.

As the method to measure the blood flow volume of the body surface, a sensor by using laser Doppler can be provided as a speaker/sensor 100-1-100-*n*. (As refer to JP2005-515818A1, for example.).

That means, as the information to display to the monitor 830 on display 240, the blood flow volume of the entire body surface can be measured by using the theory of laser Doppler, and the sequential transition of blood flow volume is further measured during therapy. Consequently, as for (a), the rate of change of the blood flow volume per unit time of entire body surface of the patient is measured. Also, the largest part of blood flow volume is made into the reference A, and the sequential change of the blood flow volume of A is measured. In addition, the relative blood flow volume of other parts to A is calculated, and this relative blood flow volume is measured with time. Then, as for (b), the rate of change (to the part where blood flow volume is the largest) of the relative blood flow volume per unit time for entire body surface of the patient is measured.

Further, the principle of a near-infrared spectroscopic method may be applied in the measurement of the blood flow by the monitor 830. In the near-infrared spectroscopic method, generally, a finger, an arm, etc., are contact to the device for measuring a blood flow. Therefore, a configuration for miniaturizing the device is preferable to diminish a side effect for the therapy. Also, since the near-infrared spectroscopic method performs only qualitative measurement of the blood flow and quality measurement cannot be performed, it is preferred to determine the rate of change of the blood flow.

<Relationship between the Monitor 820 and the Monitor 830>

An example, which uses the monitor 830 for auxiliary surveillance on the basis of the monitor 820, is explained.

During therapy, by the monitor 820, measuring the transition (state of stiffness) for the elasticity of the body surface of the patient is performed. On the other hand, auxiliary, by the monitor 830, (a) the rate of change of the blood flow volume per unit time for the entire body surface of the patient and (b) the rate of change of the relative blood flow volume per unit time for the entire body surface of the patient is measured. In the time of the therapy, as previously described, if the measured value of (a) or (b) by the monitor 830 is minus, the therapy is estimated as being unsuitable, and a warning message to adjust the therapy is displayed. Also, the control unit 200 controls the oscillating pressure and air pressure to correct more. Then, the therapy currently performed on the basis of the monitor 820 changes to the therapy on the basis of the monitor 830, temporarily. Moreover, the strength of the oscillating pressure and distribution, which are added on the basis of the monitor 830, are modified, and the therapy is performed. In this case, for example, the largest oscillating pressure is applied to the part where the blood flow volume is the smallest. Then, by subsequent therapy progress, the difference of the measured value between the monitor 820 and the monitor 830 is canceled, and if the monitor 820 is estimated to measure normally again, it will change to the therapy based on measured value by the monitor 820, automatically.

In addition, as the after-mentioned, the monitor 830 is also used to compensate the influence on the therapeutic effect by gravity.

Further, for the stronger part of stiffness, the improvement factor of the blood flow after the oscillating pressure addition to the body surface is considered high. Therefore, combining the rate of change in the hardness of the body surface by the monitor 820 and the rate of change of the blood flow by the monitor 830, etc., the level of stiffness can be estimated. Accordingly, the accuracy of measurement of the level of stiffness can be raised. That is, at the time of judging the level of stiffness, the rate of change of the blood flow can also be evaluated with combination.

In addition, using the other parameters to grasp the state of stiffness can also raise the accuracy of measurement.

(Step S105)

The control unit 200 of the pump oscillating pressure control unit 20 performs setting of the air pressure inside the apparatus, setting of the strength of the oscillating pressure applied to the body surface of the patient, etc.

With monitoring vital signs, such as a blood pressure and a pulse of the patient, the air pressure is set up so that a burden may not be added as much as possible to his/her body. That means, the airtight chamber 10 is adjusted taking into consideration the magnitude of the vibration by the oscillating pressure applied to the body surface of the patient. In this case, the air pressure inside the apparatus is gradually reduced from atmospheric pressure by the vacuum pump unit 290 with control of the control unit 200. These adjustments are generally performed automatically. However, the operator can also control manually. In addition, the control unit 200 can provide a safety system, and for example, it is enabled to cancel the lock of the airtight chamber 10 immediately in case that abnormality occurs in blood pressure and pulse for the patient during therapy.

In this case, the control unit 200 with reference to the various monitor values also performs adjustment of the oscillating pressure applied to the body surface of the patient. The oscillating pressure is adjusted to add to the entire body surface, and the strength of the oscillating pressure in this case may not be uniform. The strength of the sound wave can be applied by the inclination distribution according to the level of stiffness for the body of the patient. In this case, the strongest oscillating pressure is applied to the part having the strongest stiffness.

[The Method: Inclination Distribution of the Strength of the Sound Wave Applied to the Body Surface According to the Strength of Stiffness and Added the Strongest Sound Wave to the Strongest Part of Stiffness]

In detail, for the therapeutic apparatus X in this embodiment, the strongest sound wave is added to the part A, which is the part where the strongest stiffness is observed in the body. Then, as A>B>C, the remaining parts B, C, . . . , where the stiffness is weaker than A, the second, third, strongest sound wave are also added according to the level of stiffness.

Therefore, in A, a therapeutic effect will be highest, and the blood flow in the part improves most efficiently with the therapy. Also, in B, C, . . . , the blood flow of each part is also certainly improved by the therapy, and thus the part, which a blood flow is relatively lowered such in the case of applying an oscillating pressure at random in the time of therapy, will not be yielded. Also, by advance of therapy, the difference of the difficulty of flowing the blood between A, B, and C . . . will be reduced. Therefore, efficient therapy can be archived with safety. Also, the part, which the blood flow is most resisted in flow, is monitored, and the largest oscillating pressure can be applied there. That means, even if an unsuitable oscillating pressure occurs temporarily during therapy, it will be modified continuously. Thus, the error is not expanded with progress of therapy other than in the case of applying an oscillating pressure equally, for example.

In conclusion, as the above-mentioned reason for the therapeutic apparatus X, it is preferred that in the case of therapy, inclination distribution is performed, the strength of the sound wave added to the body surface is applied according to the strength of stiffness, and the strongest sound wave is applied to the strongest part of stiffness. As a result, effective and safe therapy is performed.

In addition, as mentioned above, the oscillating pressure added to a body surface is configured in order that the strong oscillating pressure will be applied to the stronger part of stiffness.

However, for example, by the information of the above-mentioned monitor 820, 830, etc., a configuration is also possible: if there are little differences in the level of stiffness, a pressure equivalent on the entire body is applied to the level of stiffness; and if a more difference occurs in the level of stiffness, a different oscillating pressure according to them is applied.

Thereby, according to a therapy situation, oscillating pressure can be applied flexibly, and a therapeutic effect can be boosted more.

[Measurement of the Rate of Change in Hardness]

The measured value of the hardness on the body surface can be used as an indicator to evaluate the level of stiffness. This method is explained as follows.

[The Measuring Method of Definite Stiffness]

(1) Measure the hardness of the body surface of the patient before the therapy (hardness alpha).

(2) Reduce air pressure to the patient from atmospheric pressure with the therapeutic apparatus X, and apply an intermittent tone to the body surface by equivalent strength simultaneously in this time. Thereby, as stated previously, the blood volume, which circulates through the body, increases, and it is considered that the strength of stiffness in the entire body will be advanced. The hardness of the body surface in this time is measured (hardness beta).

(3) The (hardness alpha) is subtracted from (hardness beta). That means, the information on the factors, which hardness does not change (a bone, a cartilage, etc.) is offset, and only the information on the part from which muscular hardness is changed can be extracted. In this case, assuming to carry out in the state of quiet and non-voluntary contraction of muscles is not occurring, only stiffness, as a part where hardness is changed, can be extracted. Therefore, by measuring the absolute value of the rate of change of stiffness, the strength of stiffness can be evaluated because it is considered that a part where the rate of change is larger is a part where a lot of tension accumulates.

(4) According to the distribution of stiffness and the state of the strength of stiffness which are acquired in this manner, as described previously, the largest oscillating pressure is added to the part where stiffness is the strongest. That is, the strength and applying part of the sound wave are controlled and added to the body surface.

(5) By subtracting (the hardness alpha) from the hardness (hardness gamma) of the body surface after sound wave irradiation of a definite period of time, a state of stiffness after sound wave irradiation of the definite period of time can be measured. Similarly, by subtracting, (hardness alpha) from the hardness (hardness delta) of the body surface under the therapy, (hardness epsilon), . . . , respectively, the state of stiffness can be measured in real time, a suitable oscillating pressure can be applied based on the acquired data, and safe and effective therapy can be performed.

[Adjustment of the Measuring Method of the Hardness of the Body Surface]

<About the Error of Measurement of the Hardness of the Body Surface>

About the measurement of the hardness of the body surface for the evaluation of stiffness as described previously, the strength of the sound wave added to a body surface in the case of measurement of the hardness beta can be uniform. On the other hand, in the case of measurement after the hardness gamma, the strength of the sound wave added to the body surface is adjusted in order that the strongest sound wave may be added to the strongest part of stiffness, and thus, it becomes uneven. Therefore, unlike the measured value of the hardness beta, it is possible that an error occurs in the measured value of the hardness of the body surface.

Namely, the measured value after the hardness gamma is different from the measured value of the hardness beta, and they are evaluation values in the state where the strong oscillating pressure have been applied to the strong part of stiffness. In case that strong oscillating pressure is applied to the body surface, as described previously, a cardiac and arterial pumping action is strengthened in the part by the vibration effect of the sound wave, and blood flow increases. As a result, vascular resistance increases relatively, and the stiffness may be stronger. Therefore, in the measured value after the hardness gamma, the hardness of the strong part of stiffness rather than the measured value of the hardness beta may be overestimated. In detail, regarding the part where the level of stiffness has been measured as A by the measurement before therapy, it may be estimated A+x with being overestimated by the measurement during therapy. Thus, overestimated value A+x is adjusted to the accurate value A. In addition, this overestimated value +x is correlated with the strength of the oscillating pressure applied during therapy. That is, the overestimated value +x has a higher value as the strength for the applied oscillating pressure is bigger, which means stiffness of the part is also larger. Thus, the control unit 200 is adjusted based on this value.

Regarding the influence of cardiac pulsation, etc., by a process of subtracting the influence of pulsating before and after the therapy, an artifact can be negated.

Also, in addition to cardiac pulsation, it can respond similarly to the continuous involuntary movements (thrill, etc.), which the patient cannot control by himself.

Regarding the artifact by voluntary contraction of muscles, measured values are equalized, or sudden single contraction of muscles is monitored, and the value more than a predetermined threshold is removed.

Also, a corpus spongiosum can be treated in principle as well as muscles within therapy. If erection occurs within therapy, temporarily, and that affects blood pressure and a pulse, the situation where the therapy itself becomes difficult is also considered. In that case, the control unit 200 stops therapy by warning.

In addition, in FIG. 5, the monitor of one side for the body is explained to simplify the explanation. However, in the case of therapy, the oscillating pressure can be irradiated from as many directions as possible to the body surface. Therefore, the same number of monitors that measure the state of the body surface is preferable to be installed according to the direction to be irradiated. Therefore, three above-mentioned monitors 810, 820, and 830 can draw at least in front (anterior), back (posterior), and in addition, to six directions of the body surface, including up, down, left and right can be described. Thus, it is designed to measure the state of the body surface without omission.

[Adjustment to the Influence of Gravity]

The gravity, which is not disregarded to influence for the therapeutic effect in the therapeutic apparatus X, is considered.

In this case, the influence of gravity is compensated. Accordingly, the control unit 200 is adjusted in order that the difference between the improvement factor of the total blood flow volume of the upper (anterior) body surface and the improvement factor of the total blood flow volume of the lower (posterior) body surface for the patient may not become too large before and after the therapy.

In detail, before the therapy starts, the upper body surface of the patient is set as a total blood flow volume B1, and the total blood flow volume of the lower body surface is set as B2. Similarly, per unit time after a therapy start, the total blood flow volume of the upper body surface is set as C1, and the total blood flow volume of the lower body surface is set as C2. Since both values of C1 and C2 increase with the therapy progress, all the ratios of B1/C1, B2/C2, B1/C1, and B2/C2 become small with the therapy progress. However, it does not adjust to the strength of the oscillating pressure applied to the upper part and the lower part to the patient in the therapy, since a therapeutic effect increases more under the influence of gravity in the direction below the patient as described previously, and C2 will be a larger value from C1. Therefore, the value B2/C2 becomes smaller than B1/C1, and that means B1/C1>B2/C2. Thus, within progress of the therapy, the ratio of B1/C1 and B2/C2 is measured in real time. If the value of B2/C2 becomes much smaller than B1/C1, the difference between C1 and C2 increases under the influence of gravity, and it is estimated that C2 becomes too large as compared with C1. Consequently, by increasing the oscillating pressure applied to upside of the body, C1 is to be increased in order to maintain balance.

However, in case that the lower part of the body surface has fatigued significantly as compared with upper part and stiffness is strong, the blood flow of the lower part will be improved as compared with the upper part by the therapy without influence of gravity. This may lead to a difference in the improvement factor of the blood flow between the upper part and the lower part. In this case, not only the improvement factor of the blood flow but the state of stiffness, etc., is taken into consideration, and an adjustment is performed by a predetermined formula memorized in the storage unit 220.

In addition, it is preferable that anything not come into contact with the body surface of the patient. However, if the body is settled in the bed 150 or is equipped with the external sensor, the body may be contact.

In these cases, a sensor can be installed at the part which contacts, and information, including the position of the contacted part, pressure, etc., from the sensor is analyzed with the information from a sensor provided with the bed 150 or a pressure sensor provided with the external sensor. Then, during therapy, compensation can be made by subtracting the analyzed pressure from the oscillating pressure, an apply the resulting oscillating pressure to the body surface.

Accordingly, the influence on the body surface being in contact is decreased, and it is possible that the therapy will be in the state similar to non-contact therapy.

[Adjustment of Neck Therapy]

In the therapy of the therapeutic apparatus X, sufficient adjustment is performed so that a cervical blood flow is not lowered particularly during the time of the therapy.

By the therapeutic apparatus X of this embodiment, it particularly treats cervical stiffness and lowered blood-flow as various diseases related to fatigue.

In detail, in the case of therapy, the control unit 200 can adjust and set up that sound pressure may always be added a little stronger to the neck than the other parts, and a cervical blood flow may always be maintained at a state a little higher than the other parts.

If a situation of relative declination of the cervical blood flow occurs, a warning is displayed, and it stops.

In addition, the neck is a vital organ as mentioned above, and its influence of the lowered blood flow is serious. Since there is a constriction on structure, etc., in the neck, to monitor the neck surface accurately or to apply the oscillating pressure precisely is difficult. Therefore, number of speakers/sensors **100-1-100-*n*** or the other sensors can be increased for exclusive use for the neck. This configuration enables to measure a surface state precisely and to apply the oscillating pressure accurately with the constriction.

In the case, as mentioned above, to perform the therapy safely, for example, the oscillating pressure added to the neck is always adjusted stronger than the other parts.

In addition, for the other parts which have complicated shape, such as a hand, a leg, and a male reproductive organ, and thus are difficult to monitor the body surfaces precisely or to apply pressures, speakers/sensors **100-1-100-*n*, other sensors, etc., can be provided. In this case, by miniaturizing speakers/sensors 100-1-100-*n*** and devising configuration, it can accommodate for the complicated shape.

For the above-mentioned adjustment by using the monitor, the adjustment to the influence of gravity, and the adjustment to cervix part, the control unit 200 refers the value of the monitors 810 and 820 and 830. Then, the control unit 200 calculates the oscillating pressure given to each part of the body surface from information including the blood-flow ratios, etc., and changes the strength and distribution of the oscillating pressure to add, automatically.

Finally, the control unit 200 can also adjust and correct the addition of the oscillating pressure by speakers/sensors **100-1-100-*n***. This adjustment and correction are performed in order to adjust, for example, as mentioned above, the total amount of the oscillating pressure applied to the neck in the time of the therapy may be kept always more than the other parts and the blood flow of the part may be preserved high.

In addition, the control unit 200 adjusts and corrects so that the balance of the entire oscillating pressure application may not be disrupted. In this case, the control unit 200 prevents to apply the oscillating pressure to a peripheral part, such as a leg, a head, etc., too much as compared to the part close to the center of the body of the patient, and it also avoids too much of an increase in the blood flow at the part.

Also, the control unit 200 can be carried out these adjustments and corrections based on the other parameters including the above-mentioned database.

In the therapy, the vibration by a sound wave is added to the body surface under the set-up air pressure for a definite period of time, and it is finished subsequently. After the therapy, the control unit 200 unlocks the airtight chamber 10, and thereby, the patient comes out from the bed 150.

By this therapy, wastes in the living body are excreted out from the body through the skin; and a therapeutic effect can be acquired. In order to suppress the burden on the body, this therapy can be performed several times.

Also, after one therapy finishes and the patient is out from the bed 150, the sterilization unit 295 can perform sterilization treatment for inner part of the airtight chamber 10. In addition, this sterilization treatment can also be carried out before the therapy where the patient enters to the bed 150. It is also enabled to sterilize the supplied air continuously during the therapy by ultraviolet light, etc.

As stated above, the air pressure and sound field control process of the therapeutic apparatus X are finished.

The following effects can be acquired with a configuration as mentioned above.

In the pressurization by the sound wave by the therapeutic apparatus X related to the first embodiment of the present invention, a pressure can be broadly applied to the body surface, equally. Also, the pressure can be applied throughout the body surface including a head, a face, etc., and how a pressure is applied can be varied flexibly according to physical constitution of the patient, a state of the curve of the body surface, etc.

Also, it is hard to adjust magnitude of the pressure applied to the body surface by a simple contacting structure.

On the occasion of the therapy by the therapeutic apparatus X, change can be added to the size of the pressure applied to a body surface according to the state of a body surface as stated previously. Thereby, for the pressurization by the sound wave, the strength of a pressure can be finely tuned from an extremely small value. Also, in case that a variation of the magnitude of the pressure for each part is given, smooth pressure change is enabled.

Thus, it is considered that to use a sound wave as the method of the pressurization to the body surface is extremely effective.

[The Application to Each Disease by the Therapeutic Apparatus X]

Further more, the therapeutic apparatus X related to the first embodiment of the present invention can be applied to various diseases besides fatigue and can acquire a therapeutic effect.

<Applying the Therapy to Infection>

The therapeutic apparatus X improves the filtration function and an excretion function for the skin, and it acquires a therapeutic effect by promoting excretion out the intracorporeal wastes from the body by passing the skin.

Therefore, for a patient suffered from infection, a pathogenic organism in the living body can be excreted by the same mechanism as wastes being excreted from the skin by using the therapeutic apparatus X. Thus, it is also enabled to treat infection with novel principle by the therapeutic apparatus X.

Namely, by using the therapeutic apparatus X, the pathogenic organism is excreted from the skin all over the body of the patient under the therapy by applying oscillating pressure to the whole body under air pressure lower than pressure of the atmosphere. By repeating this process, the pathogenic organism is completely removed from the inside of the body.

[Applying the Therapy to other Diseases]

Also in the other diseases, in case that the fatigue stuff accumulated in the body or a certain harmful substance in the body is the direct and indirect cause of a disease, a therapeutic effect can be acquired by removing the harmful substance by the therapeutic apparatus X. Wide application is expectable, for example, Alzheimer's disease (therapeutic effect by removal of the amyloid protein in a brain), a diffuse collagen disease (by removal of an abnormal antibody), and other various intractable disease, etc.

As an effect by a therapeutic apparatus, which applies the oscillating pressure under low pressure such as the therapeutic apparatus X, an effect of increasing the blood flow to tissue in addition to the effect of excreting wastes is acquired. With the increase of the blood flow volume to tissue, a lot of oxygen and nutrients can be supplied to the tissue, and the wastes can be removed. As a result, the effect such as recovering from fatigue faster, improving a function of a tissue, and restoring the injured tissue faster is achieved.

These are also applied about the therapy of a general disease.

A Second Embodiment

The therapeutic apparatus Y related to a second embodiment of the present invention is explained.

In the therapeutic apparatus Y of this embodiment, air pressure of a patient is reduced rather than atmospheric pressure and intermittent liquid pressure is added to a body surface of the patient simultaneously, and thus oscillating pressure is applied and performed as a treatment.

[External Appearance of the Therapeutic Apparatus Y Related to a Second Embodiment of the Present Invention]

Figure 6:
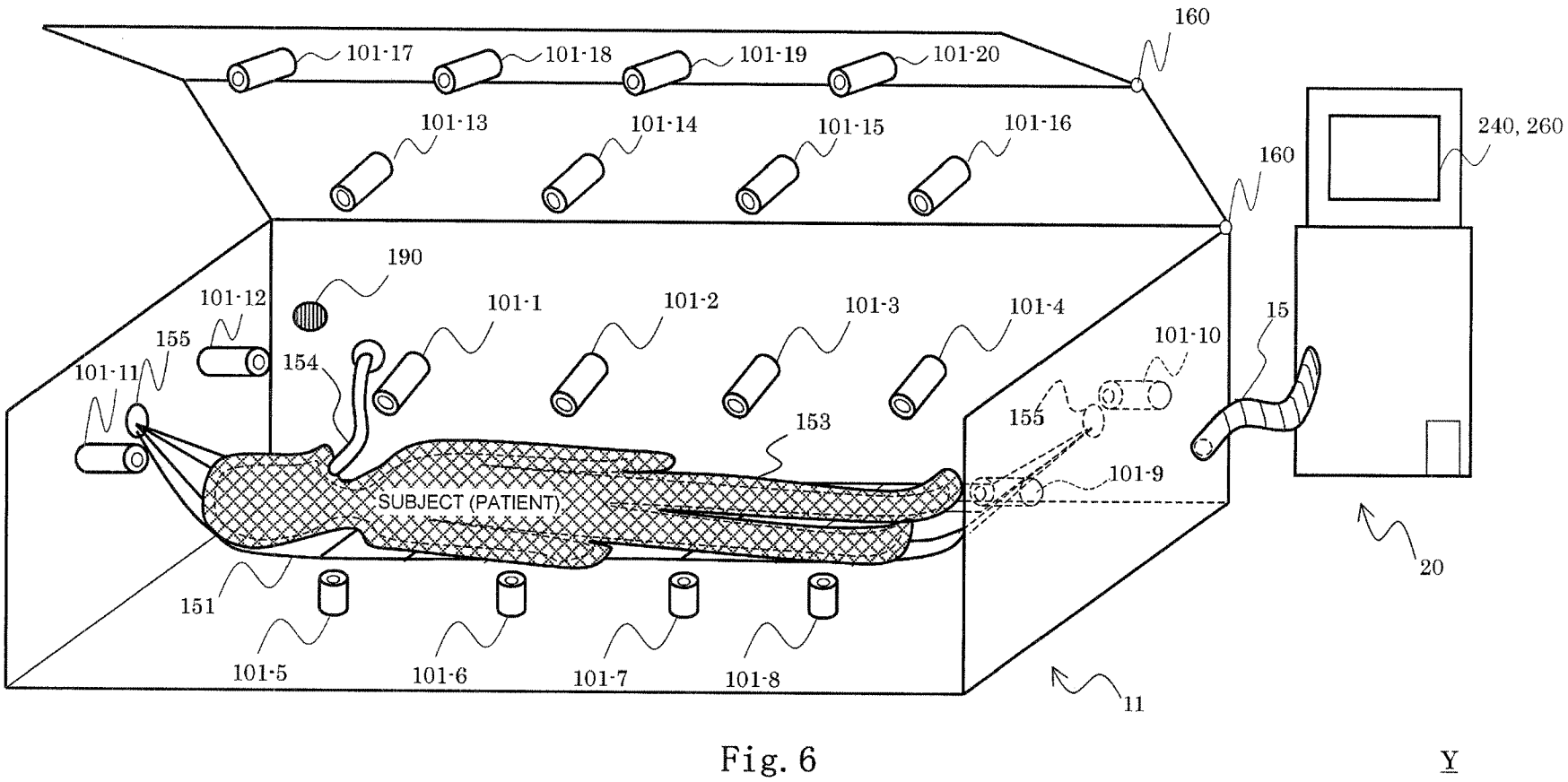
FIG. 6 is a conceptual diagram showing the external appearance of the therapeutic apparatus Y related to a second embodiment of the present invention.

As refer to FIG. 6, the therapeutic apparatus Y provides airtight chamber 11, which is similar to the airtight chamber 10 related to the first embodiment. Inside of the airtight chamber 11, a plurality of liquid pressure additional units **101-1-101-*n* (liquid pressure addition units, oscillating pressure addition units) are provided. Via the flexible waterproof sheet 153 that encloses a body surface of a subject (patient), vibration is added by intermittent liquid pressure, and he or she is treated. In FIG. 6, the part showing the same numbers in FIG. 1 has similar configuration as FIG. 1**.

That means, the therapeutic apparatus Y related to the embodiment of the invention injects fluid intermittently toward the body surface from the liquid pressure additional units **101-1-101-*n*, which are outside of the sheet 153. Thereby, the sheet 153** is pushed to the body surface of the patient with liquid pressure, and vibration can be applied to the body surface.

The liquid pressure additional units **101-1-101-*n* provide actuators and a plurality of nozzles, etc., that control injection of a fluid. They intermittently inject fluids, such as water, oil, and an ionic liquid, are toward the subject (patient), and an oscillating pressure by liquid pressure is applied. That means, the liquid pressure additional units 101-1-101-*n* function as an oscillating pressure additional unit, which is similar to the speakers/sensors 100-1-100-*n* in a first embodiment (FIG. 1**).

The liquid pressure additional units **101-1-101-*n* can adjust the speed, pressure, quantity, irradiation, etc., for the fluid to inject in a prescribed range. Also, the position of a nozzle is configured to be movable. The injected fluid are collected from a bottom, the pump oscillating pressure control unit 20 attracts them via the hose 15 and sends to the liquid pressure additional units 101-1-101-*n*** under pressure. Thereby, the fluid is circulated and used repeatedly.

Also, a plurality of various kinds of sensors are provided in the liquid pressure additional units **101-1-101-*n*, which is similar to the speakers/sensors 100-1-100-*n* of the first embodiment. The liquid pressure additional units 101-1-101-*n* can apply any liquid pressure to any position of the body surface precisely by control of the pump oscillating pressure control unit 20** based on the value of the sensors.

The bed 151 is a means to hang the patient, and this is similar to the bed 150 related to the first embodiment. For example, the bed 151 does not use hard frames, and it may be a structure by using strings such as a hammock, which may be the structure to avoid the influence on the oscillating pressure added to the hard frame. That is, by providing the hammock-like structure, effects, such as decreasing parts where addition of liquid pressure is blocked, are acquired.

If the bed 151 does not have a frame, the position of body of the patient changes easily within the therapy. Therefore, it is preferred that the position information on the body surface is measured by the sensor(s) of the liquid pressure additional units **101-1-101-*n*, and the bed 151, and the pump oscillating pressure control unit 20** can correct the influence by the motion of the body.

The sheet 153 is a part configured to surround the patient and provides a flexible waterproof sheet of resin such as vinyl chloride, polyurethane, rubbers, and metal wires, etc. During therapy, the sheet 153 entirely wraps the whole body of the patient lain on the bed. Also, the sheet 153 provides a tube 154 that carries air to a face of the patient for breathing of the patient. In addition, a plurality of wires are attached to the outside of the sheet 153, and the sheet 153 is fixed to the bed 151 by the wires.

When the patient is in a wrapped state, neither a fluid nor gas enters the inner part of the sheet 153. Therefore, the fluid injected from the nozzles of a plurality of liquid pressure additional units **101-1-101-*n* outside of the sheet 153 applies an oscillating pressure to the patient via the sheet 153. The sheet 153 can be provided with position presenting means such as a light reflector or a pattern detectable by a photo sensor of the liquid pressure additional units 101-1-101-*n*. The position (three dimensional coordinates) of the position presenting means is read by the photo sensor, etc., and each part of the pump oscillating pressure control unit 20 measures the shape and the modification position of the sheet 153, precisely. Thereby, how the sheet 153** pushed toward the body surfaces of patient by the liquid pressure can be measured and analyzed. Consequently, measurement of the hardness of the body surface for the patient is also achieved.

In addition, a position presenting means such as little metal pieces or metallic foil, which do not affect a human body, are included inside the sheet 153. By measuring the position presenting means by using a microwave radar etc., a three-dimensional shape of the sheet itself, the oscillating pressure applied to the body, the hardness of the skin, etc., can be acquired. Further, as a position presenting part, signs appearing at interference fringes can be provided, and an oscillating pressure may be measured precisely by optical method.

Furthermore, a pressure sensor by a piezoelectric element, etc., in the wire of the sheet 153 or sheet 153 itself can be provided, and the hardness of the body surface may be measured.

In addition, the sheet 153 may be a configuration having only a thin film excluding a wire. In this case, the sheet 153 has a configuration so that the body surface may not be pressed although the entire body surface is covered without space.

Also, as the sheet 153, a resin, etc., which can pass air but cannot pass a fluid may be used. Also, a waterproof moisture permeable material such as Gore-Tex (Registered trademark) may be used. In this case, it is preferred that a patient be equipped with a mask, etc., for enabling to breathe.

Also, the sheet 153 can be configured to not contact the patient directly during case of therapy and separated by a predetermined distance from the body surface slightly, and the patient may be wrapped in it. In the case of such a configuration, when pressure by the fluid is run out, the sheet 153 will separate from the body of the patient promptly and return to an original position by tension with the wire of the sheet 153 or elasticity of the sheet 153 itself. In this case, the length and tension of the wire outside the sheet 153 can be adjusted in a predetermined range, the oscillating pressure applied to the body surface can be adjusted by combining with adjustment of the injected fluid.

Also, the sheet 153 can be configured as divided into some parts and surround the patient. In this case, for example, the sheet 153 is divided in six directions, upper and lower sides, left or right, and back and front, and are held to the patient by a belt, etc. Thereby, an excessive blocking feeling is avoidable.

Also, the sheet 153 may be a bag-like structure. In this case, a configuration so that fluid may not leak to the outside of the sheet 153 is possible, and the liquid pressure additional units **101-1-101-*n* may be provided inside of the bag of the sheet 153. That is, a fluid is injected from the nozzle of the liquid pressure additional units 101-1-101-*n* inside in the bag, and the oscillating pressure by liquid pressure is applied toward the patient of the outside of the bag via the sheet 153. In this case, the patient may be wrapped with the divided marsupial sheet 153** as mentioned above. With a configuration in this manner, the patient is hard to get wet, and an effect is acquired that handling the fluid is easy.

[Air Pressure and Water Pressure Control Processing of the Therapeutic Apparatus Y]

Then, the steps of the air pressure and water pressure control process, which treats fatigue with the therapeutic apparatus Y of this embodiment is explained.

Air pressure and water pressure control processing in the therapeutic apparatus Y is similar to the air pressure and sound field control processing related to a first embodiment (FIG. 3), and the process is performed with decreasing air pressure and adding an oscillating pressure.

In this case, in the therapeutic apparatus Y related to a second embodiment of the present invention, the liquid pressure additional units **101-1-101-*n*** as a liquid pressure addition unit is placed in order to surround the patient, and liquid pressure, timing of injection, etc., for the fluid, which is injected from a plurality of nozzles, are adjusted. Thereby, addition of the oscillating pressure to the patient by intermittent liquid pressure is controlled.

Therefore, in the therapeutic apparatus Y of this embodiment, the oscillating pressure adjustment unit 251 (FIG. 1) functions as a hydraulic pressure adjusting part (liquid pressure adjustment device). The oscillating pressure adjustment unit 251 performs the calculation and control for adjusting the fluid injected from each nozzle based on the value from each sensor.

Also, the tissue hardness calculation unit 255 (FIG. 1) measures change of the position in the sheet 153 during therapy, or calculates to determine the degree of tissue hardening from the value of the pressure sensor installed in the sheet, etc.

In the air pressure and water pressure control processing in the therapeutic apparatus Y, as similar to the decompression/oscillating pressure addition process (FIG. 3), the control unit 200 transmits a control signal to the liquid pressure additional units **101-1-101-*n* by using the I/O unit 230**.

Thereby, fluid is injected from the nozzles of the liquid pressure additional units **101-1-101-*n***, and liquid pressure is applied to the body of the patient. The fluid is injected orderly and intermittently, and thus vibration is added to the body surface. The strength, rhythm, etc., for liquid pressure are set up freely and are adjusted automatically based on a database, which is similar to the case of adding sound pressure.

Also, in the sensor acquisition process in the therapeutic apparatus Y, the shape and the movement position of the sheet 153 are monitored as similar to the therapeutic apparatus X related to the above-mentioned first embodiment, and a motion by adding oscillating pressure to the body surface of the patient during the therapy is detected and analyzed. Accordingly, the hardness and the rate of change in the hardness for the body surface of the patient can be measured.

In the monitor process in the therapeutic apparatus Y, the distribution and the strength of liquid pressure added to the body surface of the patient are measured, the range and strength of vibration applied to a body surface by the liquid pressure are watched during therapy, and information is displayed on the display 240 by the monitor 810.

In this case, the control unit 200 displays the result calculated by the oscillating pressure adjustment unit 251 based on information including the distance from each nozzle to the body surface, the strength of the liquid pressure injected from each nozzle, the number of nozzles, etc. This calculated result can be displayed in real time in a similar manner to the sound pressure of the first embodiment. Also, the control unit 200 adjusts distribution of the oscillating pressure in conjunction with each nozzle of the liquid pressure additional units **101-1-101-*n***.

In addition, for the configuration that the pressure sensor is built into the inner part of the sheet 153, when liquid pressure is applied to the body surface via the sheet 153, the pressure of the body surface can be measured by the pressure sensor and be compared with the applied pressure. In this manner, for measuring the hardness of the body surface, publicly known technology described in a JP2011-047711A or the like, for example, may be used.

Also, the measurement of the hardness without touching the body surface and the measurement of the hardness with the pressure sensor can be used properly. A method of using sound wave, microwave, or a photo sensor can be used not only in the case of using the therapeutic apparatus Y but in the case of adding sound pressure by using the therapeutic apparatus X related to the first embodiment. Also, the method by using the pressure sensor in the sheet 153 can be used in the case of liquid pressure addition by the therapeutic apparatus Y. Also, the method of using the thermometer can be used both in the case of the sound pressure addition by the therapeutic apparatus X and the liquid pressure addition by the therapeutic apparatus Y.

Also, in the therapeutic apparatus X and the therapeutic apparatus Y, the hardness of the body surface is measurable by irradiating microwave to the body surface and analyzing them.

Further, the sound pressure addition by the therapeutic apparatus X related to a first embodiment and the liquid pressure addition by the therapeutic apparatus Y related to a second embodiment can be properly used according to each special feature.

The sound pressure addition by the therapeutic apparatus X is suitable for applying an equivalent oscillating pressure broadly. Sound pressure causes a little unevenness in applying the oscillating pressure, and thus the oscillating pressure can be applied all over the body. Also, the sound pressure becomes a little blocked by the bed 150, etc., but can efficiently be applied as oscillating pressure to the body surface, directly. Also, the sound pressure can be applied without contact and is not too strong. Also, sound pressure is safe and causes little burden. Therefore, sound pressure addition is effective in the patient, etc., who is short on physical strength, especially. In addition, for the property of a sound wave, when strength of the pressure applied to the position is varied, it can be adjusted with the active noise controller to control the part where the pressure is applied. Even in this case, the sound pressure on the body surface will have a gentle difference.

On the other hand, since the liquid pressure addition by the therapeutic apparatus Y can enlarge the oscillating pressure applied to one position, it can apply a large pressure with pinpoint. That is, a large difference can be applied to the strength of an oscillating pressure between the positions. Therefore, it is preferred to use liquid pressure, in the case that strong pressure is needed to be applied to a specific part in the time of therapy. Also, for patients that have good strength, therapy by the oscillating pressure is effective in a short time.

Also, since structures are different between the therapeutic apparatus X and the therapeutic apparatus Y, such as an existence of a sheet, a sensor, it can also be used as required as a separate apparatus.

A Third Embodiment

Figure 7:
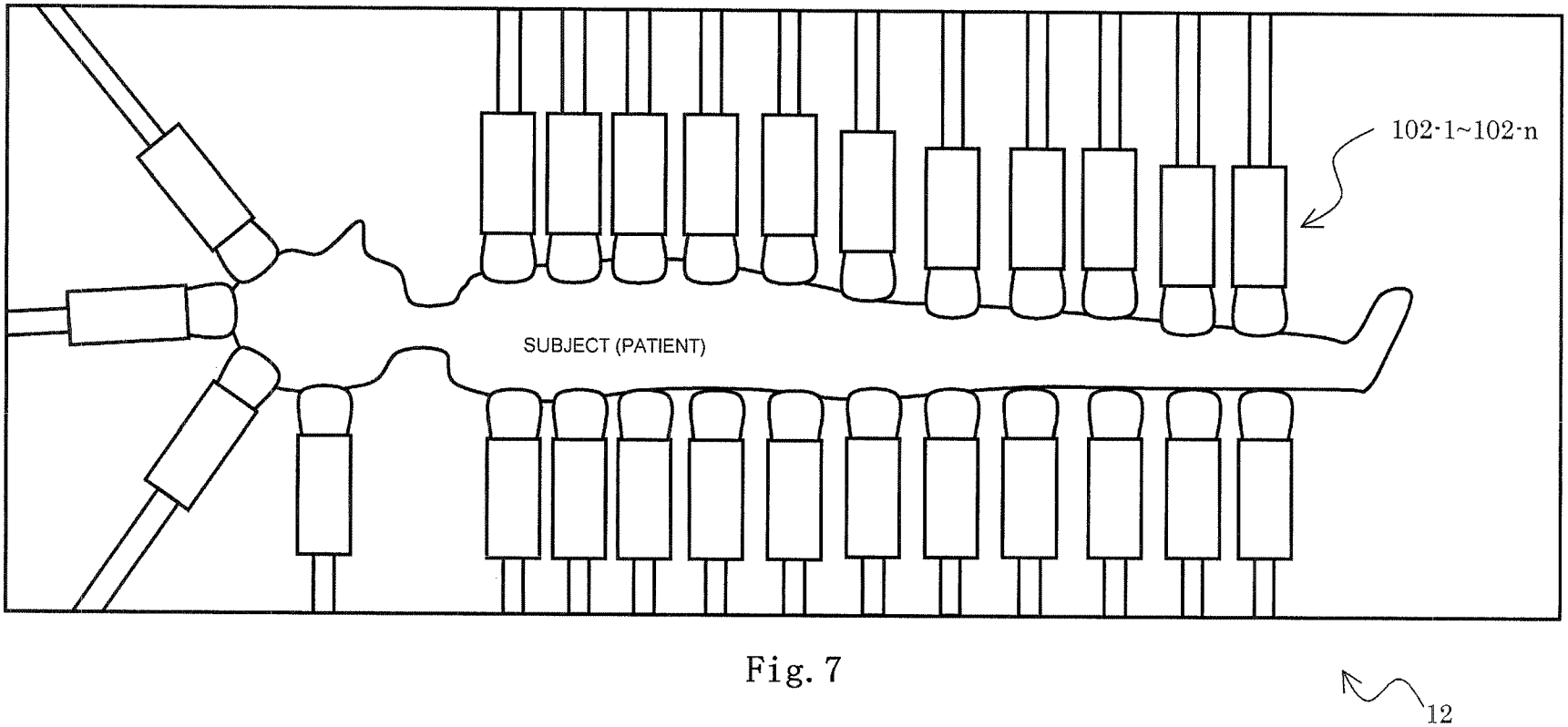
FIG. 7 is a conceptual diagram showing the inner part of the airtight chamber 12 related to the third embodiment of the present invention.
Figure 8:
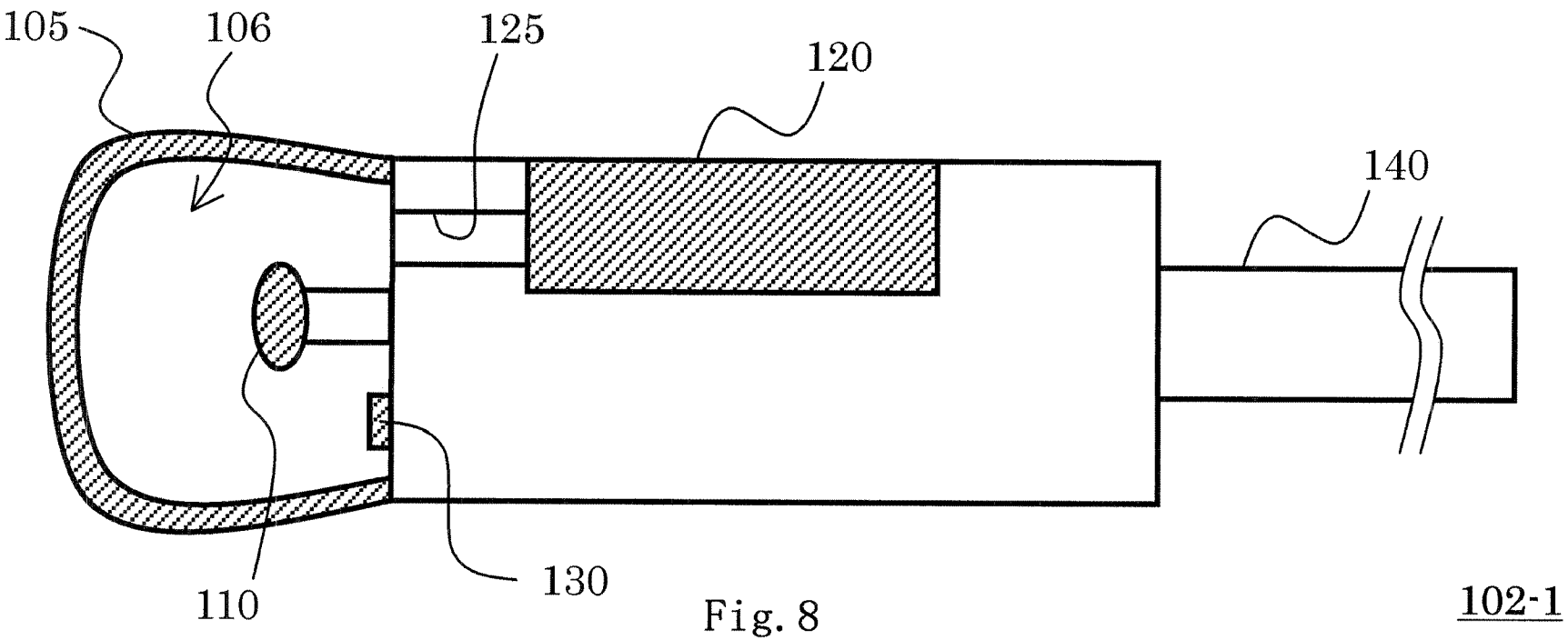
FIG. 8 is an outline sectional view of the oscillating additional unit 102-1 related to the third embodiment of the present invention.
Figure 9:
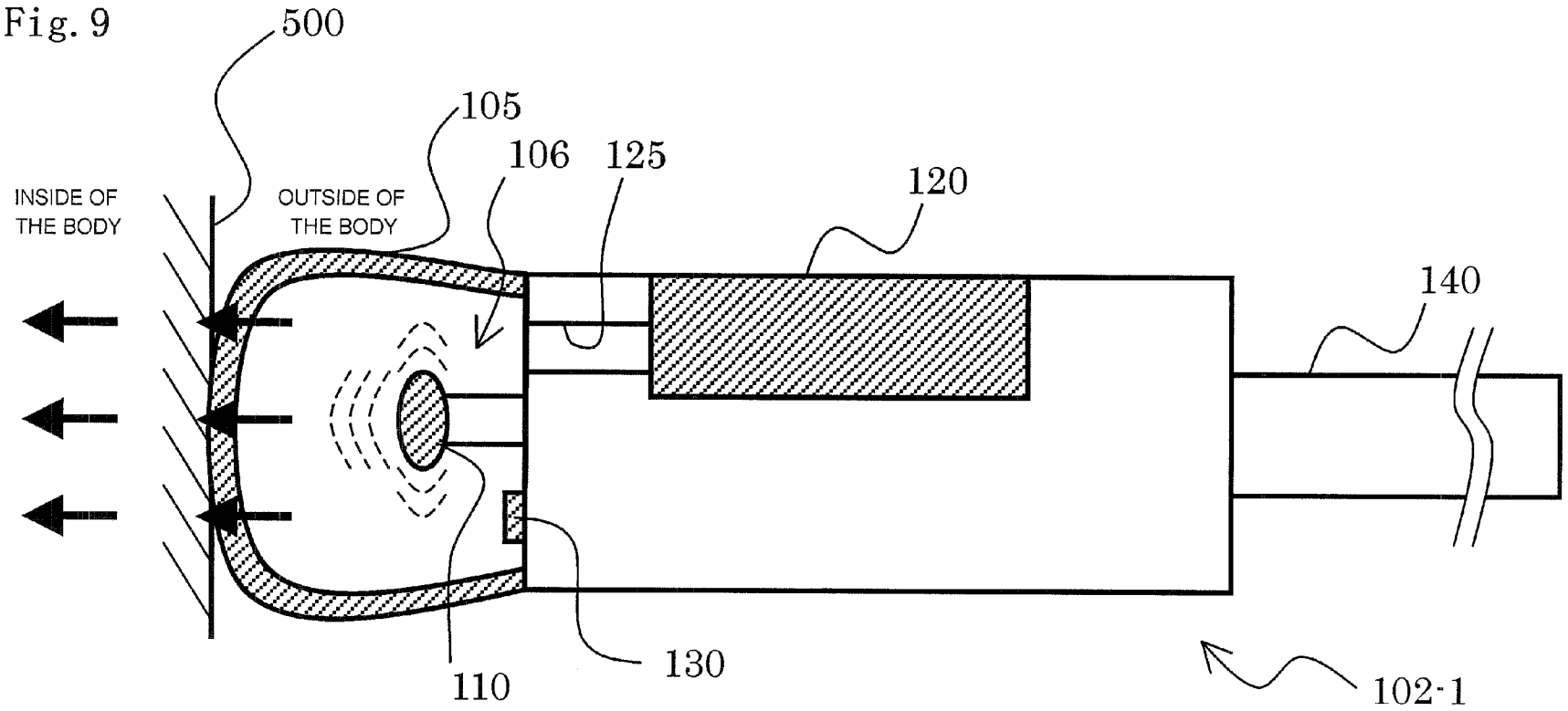
FIG. 9 is a conceptual diagram of addition of the oscillating pressure by the oscillating additional unit 102-1 related to the third embodiment of the present invention.

Referring to FIG. 7-FIG. 9, the therapeutic apparatus Z related to the third embodiment of the present invention is explained.

The therapeutic apparatus Z of this embodiment operates by reducing air pressure for a patient rather than atmospheric pressure and by adding oscillating pressure via fluid intermittently by the oscillating additional units **102-1-102-*n*** (oscillating pressure additional units) to a body surface of the patient, simultaneously.

In the therapeutic apparatus Z of this embodiment, the configuration other than the airtight chamber 12 where the oscillating additional units **102-1-102-*n* (FIG. 7**) are provided, is similar to those of the therapeutic apparatus X related to the above-mentioned first embodiment and the therapeutic apparatus Y related to the second embodiment.

[The Configuration in the Airtight Chamber 12]

Referring to the outline sectional view of FIG. 7, the configuration in the airtight chamber 12 at the time of the therapy is explained.

In the airtight chamber 12, a plurality of oscillating additional units **102-1-102-*n* are arranged, an oscillating pressure is added to a body surface of a subject (patient) by these. A plurality of oscillating additional units 102-1-102-*n* are placed in order that the body surface of the subject (patient) may be surrounded, and each of them touches the body surface of the patient. Thereby, oscillating pressure of any strength can be applied to any position of the body surface for the patient. Also, in this embodiment, in the treatment, the patient can be laid on the lower oscillating additional units 102-1-102-*n*** in the perpendicular direction.

The oscillating additional units **102-1-102-*n* can be driven in a direction towards or away from the body surface of the patient. Therefore, the oscillating additional units 102-1-102-*n* can be controlled according to the state of the body surface of the patient, and they can be stuck without a gap to the body surfaces. Also, the oscillating additional units 102-1-102-*n* can adjust the pressure applied to the body surface. In this case, the applied pressure is adjusted so that the excessive pressure may not be added in the lower oscillating additional units 102-1-102-*n***.

In addition, a configuration of providing a tube similar to the tube 154 in the second embodiment, etc., to supply breathing air for the patient is possible.

Also, the body of the patient may be laid in the bed 150 (FIG. 1) related to the first embodiment or the bed 151 (FIG. 6) related to the second embodiment other than the oscillating additional units **102-1-102-*n*. That is, the body of the patient may be fixed to space with structure such as a hammock. In this case, it is not necessary to adjust the pressure of the lower oscillating additional units 102-1-102-*n*** according to weight of the patient, etc.

Also, a configuration that each of the oscillating additional units **102-1-102-*n*** may be in close contact with the patient is possible.

Also, by being smaller the size and having an increased number of the oscillating additional units **102-1-102-*n***, high-precision safe therapy can be carried out.

[The Configuration of the Oscillating Additional Unit 102-1]

Then, referring to FIG. 7, the oscillating additional units **102-1-102-*n* of the therapeutic apparatus Z related to the third embodiment of the present invention are explained (in the following, the oscillating additional unit 102-1** is explained as an example of representation.).

FIG. 8 is an outline sectional view of the oscillating additional unit 102-1.

As a configuration, the oscillating additional unit 102-1 includes a head section 105, an exciter 110 (a driving unit, an oscillating pressure generating unit), a temperature control unit 120 (temperature control unit), a sensor 130, and the attaching part 140. The head section 105 is configured with a film-like, a hemispherical, or a dome sheet made of a flexible resin, etc. The head section 105 is contacted with a subject (patient) in the similar manner to the sheet 153 related to the second embodiment, and it is a part that adds vibration to the body surface. The inner part of the head section 105 is filled with the fluid 106, such as water, oil, and an ionic liquid.

The exciter 110 is a vibration generating part, which is configured with a piezoelectric element, an electromagnetic actuator, a vibrating motor, etc. The exciter 110 is located inside of the head section 105 as surrounded by the fluid 106. By vibrating exciter 110 itself, an oscillation of any strength can be generated to cause the fluid 106 to vibrate. In detail, the exciter 110 generates mainly a low frequency wave (about 80 Hz-500 Hz) oscillation in the fluid 106 in the head section 105 by control of the control unit 200 connected via the I/O unit 230 (FIG. 2). This oscillation is transmitted to the fluid 106 and is conducted to the body surface of the patient via the head section 105. Thereby, an oscillating pressure is added to the body surface of the patient.

The temperature control unit 120 is a part to control temperature with a heat sink, a Peltier device, a fan, etc. The temperature control unit 120 is opened to provide for free passage from the passage 125 to the head section 105, and the temperature of the fluid 106 in the head section 105 is adjusted. The temperature control unit 120 cools the fluid 106 in case that the temperature of the fluid 106 rises more than prescribed temperature by the vibration of the exciter 110. Also, the temperature control unit 120 can warm the temperature of the fluid 106 in accordance with the above-mentioned monitor of the blood flow or the hardness of the skin. Thereby, the part in contact with the patient will be heated.

The sensors 130 include a photo sensor, a pressure sensor, a temperature sensor, etc., and obtain the body condition of the patient via the fluid 106 in the similar manner to the speakers/sensors **100-1-100-*n* related to the above-mentioned first embodiment (FIG. 1) or the liquid pressure additional units 101-1-101-*n* related to the second embodiment (FIG. 6). The photo sensor of the sensors 130 can be provided with combining infrared LED, etc., and a photo detector as measured opacity, pulse, and a blood flow of the skin of the patient directly via the fluid 106. Also, a sensor 130 that irradiates light or a sound wave to the skin and measures the thickness of the skin by the difference in the absorbance can be used. Further, sensors 130 can be provided in the head section 105, and may contact the patient directly. In addition, sensors 130**, such as thermometers, etc., which measure each part of the body for the patient may be separately provided.

Furthermore, a configuration, which does not use the temperature control unit 120, is possible.

[Air Pressure and an Oscillating Pressure Control Process of the Therapeutic Apparatus Z]

Each part of the pump oscillating pressure control unit 20 analyzes the data obtained by the sensors 130 provided in the inner part of the head section 105 as mentioned above, the data of a thermometer, etc., and measure the hardness or the rate of change in the hardness of the body surface for the patient.

Also, a near-infrared spectroscopic method, etc., may be used for measuring change of the blood flow volume accompanying the therapy, and the change in blood can be reflected in the therapy.

The pump oscillating pressure control unit 20 can measure vital sign of the patient, etc. Further, the pump oscillating pressure control unit 20 controls for adding the strongest vibration to the strongest part of stiffness by one of the oscillating additional units **102-1-102-*n*** which contacts with.

[About the Judgment Method of the Therapeutic Effect for Stiffness in Detail]

The therapeutic apparatus Z of this embodiment estimates how wastes are excreted from inside of the body with the therapy, which is similar to the monitor process (FIG. 3) related to the first and the second embodiment.

However, the therapeutic apparatus Z does not directly measure the wastes excreted from inside of the body as the judgment method of stiffness. Therefore, each part of the pump oscillating pressure control unit 20 measures the following items.

(1) Measure a Sequential Change of the Rate of Change in the Hardness of the Body Surface Accompanying Therapy.

As mentioned above, stiffness of the body surface is estimated with the rate of change in the hardness of the body surface. The rate of change will be larger as the stiffness is stronger. Thus, the rate of change in the hardness of the body surface is measured over time during therapy. In case that the rate of change becomes small, it is estimated that stiffness has improved. Otherwise, in case that the rate of change becomes close to 0, it is estimated that all wastes are removed.

(2) Measure a Sequential Change of the Distribution for the Level of Stiffness to the Body Surface.

The stiffness of the body surface has various levels in each part before the therapy. The therapy apparatus performs treatment by applying the largest oscillating pressure to the part where stiffness is the strongest. Therefore, as the therapy progresses, the difference in the level of stiffness for each part of the body surface decreases and, finally, becomes close to 0. In such case, it is estimated that considerable level of waste removal is also performed.

(3) Measure the Rate of Change of the Blood Flow for the Body Surface, a Sequential Change of the Difference by the Part of the Rate of Change In performing the therapy, since the blood flow of each part of the body surface improves, the rate of change of the blood flow will be plus. However, since the blood flow does not increase after all wastes are removed, it is estimated that the rate of change becomes close to 0. Also, the difference of the rate of change for the blood flow between the parts also gradually becomes small due to the reasons explained previously; and finally, it becomes close to 0. In that case, it is estimated that all wastes are removed.

(4) Measure the Opacity of the Skin before and after the Therapy

When therapy is performed and the wastes are excreted from the skin surface, it is expected that the opacity of the skin decreases by the excreted wastes. Therefore, by measuring the opacity of the skin before and after the therapy by the sensor 130, a condition for the excretion of the wastes can be understood. Here, when there is no change for the opacity of the skin before and after therapy, it is estimated that all wastes are removed.

Each part of the pump oscillating pressure control unit 20 interprets the overall item of these (1)-(4) and performs the judgment for the therapeutic effect, the judgment for the time of the end of the therapy, etc.

In addition, the control unit 200 puts all of these results in a database in the storage unit 220. Thereby, those items can be estimated more precisely for the same patient. Further, based on this database, the control unit 200 can also make a treatment plan that includes an additional treatment and span of the treatment that may be suitable for an individual case.

Also, the control unit 200 can refer to and adjust the therapy for example based on an estimate of the effect of the therapy on infection, clinical data, such as measured value of the viral load in blood, etc.

By the configuration as mentioned above, for the therapeutic apparatus Z of this embodiment, configuration of the apparatus can be simple, and the effect of reducing cost is acquired as compared with the therapeutic apparatus X related to the first embodiment that uses a sound wave, or the therapeutic apparatus Y related to the second embodiment that uses a liquid flow.

Also, since the fluid 106 is used, the oscillating pressure can be enlarged as compared with the sound wave, and a therapeutic effect may also be increased.

Also, there is no requirement that makes the patient enter in the sheet 153 of the therapeutic apparatus Y, etc. Therefore, the patient can be treated conveniently.

In addition, a mechanical part can be used as an oscillating pressure addition unit. For example, a plurality of a mechanical arm, a low frequency massage machinery, etc., are located in order to surround the body surface of the patient as an oscillating plate in the similar manner to the concussion additional unit **102-1-102-*n***, the oscillating plate is in contact with the whole body surface, and vibration of any strength can be added to any part of the body surfaces. These oscillating plates can include, a vibrating plate of a publicly known strike-type massage device having a motion to vibrate (for example, refer to JP H10-216191A). In addition, by using a lot of the oscillating plates, which are miniaturized, a therapeutic effect is boosted.

Further, to reduce the burden for the body surface, an impact-absorbing material, such as a gelatinous substance (jelly-like substance), can also be attached to the part in contact with the body surface of the oscillating plate.

As configured in this way, the apparatus will be simple and convenient. However, in case that a lot of oscillating units are provided simply, an infestation to the body surface may be larger. Therefore, it is preferred to adjust the strength of vibration finely by miniaturizing the oscillating plate and increasing the number of them. Also, treatment can be performed in combination with other means.

Some further examples are provided to explain the present invention. However, the following examples do not restrict the present invention.

Example 1

(Experimental Method)

The oscillating pressure by sound pressure was added in accordance with the therapeutic apparatus X related to the first embodiment.

In detail, the oscillating pressure by sound pressure was applied to the body surface by using a speaker under the ordinary atmospheric pressure (1011 hPa) and under the air pressure at an altitude of 640 m (938 hPa). Blood pressure and a pulse were measured during the time of (i) resting period, (ii) during oscillating pressure addition, and (iii) resting period after addition, respectively. Also, an extent of improvement of the stiffness of the body by oscillating pressure addition at the ordinary atmospheric pressure and at the altitude of 640 m were evaluated, respectively. As speakers, ONKYO D-77MRX (rated impedance 6 ohms, maximum input 150 W, rated response level 90 dB/W/m, and rated frequency range of 30-60 kHz) were used. As an amplifier, Pioneer A-636 was used with the loudness function and fixed the volume to 40 dB. As the sound source, heavy low sound effect CD (JUST BOOM TRAX, CRYPTON FUTURE MEDIA, INC.) was used, and the intermittent tone of the heavy low on Track 35 of disc 2 was played.

The irradiated part of sound pressure was the left neck, and there was consciousness of strong stiffness at the time of the experiment. The irradiated part was adjusted to the same part under the ordinary atmospheric pressure and under the air pressure at the altitude of 640 m, respectively.

Measurement of the blood pressure and the pulse were performed every minute by using a sphygmomanometer for home use (HEM-7251G, OMRON HEALTHCARE Co., Ltd).

The altitude and air pressure were measured with a digital manometer (REGULUS BR-88exx, SANOH CO., LTD).

A measurement result is shown in the table 1 as follows.

TABLE 1

| RESTING PERIOD | | | DURING OSCILLATING PRESSURE ADDITION | | | RESTING PERIOD, AFTER OSCILLATING PRESSURE ADDITION | | |
|---|---|---|---|---|---|---|---|---|
| No. | BLOOD PRESSURE (UPPER-LOWER) | PULSE | No. | BLOOD PRESSURE (UPPER-LOWER) | PULSE | No. | BLOOD PRESSURE (UPPER-LOWER) | PULSE |
| (a) UNDER THE ORDINARY ATMOSPHERIC PRESSURE (1011 hPA) | | | | | | | | |
| 1 | 135-91 | 63 | 1 | 136-97 | 70 | 1 | 112-66 | 63 |
| 2 | 131-95 | 64 | 2 | 138-101 | 63 | 2 | 114-72 | 63 |
| 3 | 131-95 | 65 | 3 | 134-99 | 61 | 3 | 112-76 | 63 |
| 4 | 132-92 | 62 | 4 | 136-98 | 60 | 4 | 116-76 | 61 |
| 5 | 131-93 | 62 | 5 | 136-97 | 60 | 5 | 114-74 | 62 |
| 6 | 131-92 | 61 | 6 | 133-96 | 61 | 6 | 113-74 | 69 |
| AVERAGE | 132-93 | 63 | 7 | 129-97 | 60 | AVERAGE | 114-73 | 64 |
| | | | 8 | 135-102 | 61 | | | |
| | | | 9 | 132-97 | 60 | | | |
| | | | 10 | 135-98 | 61 | | | |
| | | | 11 | 131-101 | 61 | | | |
| | | | 12 | 128-99 | 61 | | | |
| | | | 13 | 128-94 | 61 | | | |
| | | | 14 | 129-96 | 62 | | | |
| | | | 15 | 136-98 | 60 | | | |
| | | | 16 | 123-92 | 59 | | | |
| | | | 17 | 128-93 | 60 | | | |
| | | | AVERAGE | 132-97 | 61 | | | |
| (b) UNDER THE AIR PRESSURE AT AN ALTITUDE OF 640 m (938 hPA) | | | | | | | | |
| 1 | 132-95 | 77 | 1 | 156-103 | 80 | 1 | 134-98 | 70 |
| 2 | 136-101 | 75 | 2 | 159-111 | 74 | 2 | 136-91 | 68 |
| 3 | 135-100 | 73 | 3 | 162-116 | 73 | 3 | 132-99 | 67 |
| 4 | 140-100 | 74 | 4 | 157-118 | 73 | 4 | 130-97 | 66 |
| 5 | 133-100 | 71 | 5 | 163-117 | 77 | 5 | 133-94 | 68 |
| 6 | 134-102 | 73 | 6 | 158-109 | 73 | 6 | 136-100 | 68 |
| AVERAGE | 135-100 | 74 | 7 | 155-112 | 71 | AVERAGE | 134-97 | 68 |
| | | | 8 | 163-117 | 72 | | | |
| | | | 9 | 157-111 | 73 | | | |
| | | | 10 | 151-109 | 70 | | | |
| | | | 11 | 167-118 | 70 | | | |
| | | | 12 | 163-121 | 70 | | | |
| | | | 13 | 171-121 | 69 | | | |
| | | | 14 | 162-118 | 69 | | | |
| | | | 15 | 167-126 | 72 | | | |
| | | | 16 | 156-117 | 72 | | | |
| | | | 17 | 161-121 | 70 | | | |
| | | | 18 | 159-117 | 69 | | | |
| | | | 19 | 174-123 | 72 | | | |
| | | | 20 | 164-120 | 70 | | | |
| | | | 21 | 162-121 | 72 | | | |
| | | | 22 | 168-118 | 68 | | | |
| | | | 23 | 159-112 | 70 | | | |
| | | | 24 | 165-123 | 72 | | | |
| | | | AVERAGE | 162-117 | 72 | | | |

(Result)

When an oscillating pressure was applied under the ordinary atmospheric pressure, a large difference was not found for the blood pressure and the pulse as compared with a resting period, and the significant change to the subjective symptoms of stiffness were not observed.

On the other hand, under the air pressure at the altitude of 640 m, a large change was not observed in a pulse as compared with the resting period at the time of adding the oscillating pressure. Nevertheless, blood pressure raised, and oscillating pressure addition reduced the subjective symptoms of stiffness.

As for this, it is estimated that oscillating pressure addition raises as a function of a cardiovascular system, and consciousness of stiffness is reduced by rise of the excretion function of wastes.

Example 2

(Experimental Method)

With an ordinary atmospheric pressure (1000 hPa) or an air pressure at an altitude of 740 m (927 hPa), the oscillating pressure was applied to the body surface by using an electric massager for household use.

Blood pressure and a pulse were measured during the time of (i) a resting period, (ii) during oscillating pressure addition, and (iii) the resting period after addition, respectively. Also, an extent of improvement of the stiffness of the body by oscillating pressure addition in the ordinary atmospheric pressure and in the altitude of 740 m were evaluated, respectively.

As the electric massager for household use, a handy-type massager, which a massaging head vibrates, was used (Tappie, THRIVE CO., LTD). For the vibration frequency, "low" (about 2700 times/min) was selected.

The massaging head of the massager was applied to the left neck. The consciousness of strong stiffness was found in the part at the time of the experiment. The part to contact was adjusted to the same part under the ordinary atmospheric pressure and under the air pressure at the altitude of 640 m, respectively.

Measurement of the blood pressure and the pulse were performed every minute by using a sphygmomanometer for home use (HEM-7251G, OMRON HEALTHCARE Co., Ltd).

The altitude and air pressure were measured with a digital manometer (REGULUS BR-88exx, SANOH CO., LTD).

A measurement result is shown in the following table 2.

Under the air pressure at the altitude of 740 m, as compared with the resting period, blood pressure raised, and the subjective symptoms of stiffness were greatly reduced at the time of oscillating pressure addition. Pulse rate increased a little.

Therefore, a clear therapeutic effect is recognized by the oscillating pressure addition by the massager under a low pressure.

In addition, in Examples 1 and 2, to confirm no adverse effect to the body, the vital check, etc., are frequently performed during the experiment. Also, although the oscillating pressure addition to the body surface under the low pressure is limited as much as possible for a short time, the objective and perceive effect can be achieved.

TABLE 2

| RESTING PERIOD | | | DURING OSCILLATING PRESSURE ADDITION | | | RESTING PERIOD, AFTER OSCILLATING PRESSURE ADDITION | | |
|---|---|---|---|---|---|---|---|---|
| No. | BLOOD PRESSURE (UPPER-LOWER) | PULSE | No. | BLOOD PRESSURE (UPPER-LOWER) | PULSE | No. | BLOOD PRESSURE (UPPER-LOWER) | PULSE |
| (a) UNDER THE ORDINARY ATMOSPHERIC PRESSURE (1000 hPA) | | | | | | | | |
| 1 | 113-74 | 61 | 1 | 111-74 | 65 | 1 | 112-66 | 63 |
| 2 | 112-73 | 61 | 2 | 114-74 | 63 | 2 | 114-72 | 63 |
| 3 | 114-76 | 61 | 3 | 118-74 | 62 | 3 | 112-76 | 63 |
| 4 | 109-76 | 62 | 4 | 114-76 | 65 | 4 | 116-76 | 61 |
| 5 | 107-74 | 63 | 5 | 113-75 | 64 | 5 | 114-74 | 62 |
| 6 | 107-74 | 62 | 6 | 107-72 | 63 | 6 | 113-74 | 69 |
| AVERAGE | 110-75 | 62 | 7 | 116-75 | 64 | AVERAGE | 114-73 | 64 |
| | | | 8 | 112-76 | 60 | | | |
| | | | 9 | 110-73 | 63 | | | |
| | | | 10 | 108-76 | 65 | | | |
| | | | 11 | 115-77 | 64 | | | |
| | | | 12 | 117-76 | 64 | | | |
| | | | 13 | 111-75 | 65 | | | |
| | | | 14 | 112-78 | 63 | | | |
| | | | AVERAGE | 113-75 | 63 | | | |
| (b) UNDER THE AIR PRESSURE AT AN ALTITUDE OF 740 m (927 nPA) | | | | | | | | |
| 1 | 127-83 | 81 | 1 | 134-94 | 80 | 1 | 133-92 | 78 |
| 2 | 128-91 | 83 | 2 | 132-93 | 79 | 2 | 121-92 | 78 |
| 3 | 125-87 | 80 | 3 | 129-94 | 80 | 3 | 128-88 | 75 |
| 4 | 124-91 | 81 | 4 | 132-94 | 79 | 4 | 129-92 | 77 |
| 5 | 118-86 | 78 | 5 | 132-90 | 80 | 5 | 127-91 | 79 |
| 6 | 120-88 | 77 | 6 | 131-95 | 81 | 6 | 129-89 | 76 |
| AVERAGE | 124-88 | 80 | 7 | 134-95 | 83 | AVERAGE | 128-91 | 77 |
| | | | 8 | 129-81 | 78 | | | |
| | | | 9 | 138-99 | 83 | | | |
| | | | 10 | 139-102 | 85 | | | |
| | | | 11 | 139-96 | 85 | | | |
| | | | 12 | 138-99 | 83 | | | |
| | | | 13 | 133-100 | 85 | | | |
| | | | 14 | 137-95 | 83 | | | |
| | | | 15 | 137-92 | 84 | | | |
| | | | 16 | 134-95 | 85 | | | |
| | | | 17 | 134-94 | 83 | | | |
| | | | 18 | 126-88 | 83 | | | |
| | | | 19 | 126-86 | 83 | | | |
| | | | 20 | 135-96 | 83 | | | |
| | | | 21 | 146-97 | 81 | | | |
| | | | 22 | 132-89 | 84 | | | |
| | | | 23 | 143-96 | 83 | | | |
| | | | 24 | 131-88 | 83 | | | |
| | | | AVERAGE | 134-94 | 82 | | | |

(Result)

When an oscillating pressure was applied under the ordinary atmospheric pressure, large differences were not found for the blood pressure and the pulse as compared with the resting period. However, the subjective symptoms of stiffness had improved slightly.

However, in the state where safety is not established without the presence of operators, such as a doctor and a therapeutic, since there is a possibility of causing an unexpected situation when a long-time of oscillating pressure addition on the body under the low pressure, etc., are performed.

The present invention is not limited to the description of the embodiments above, but may be altered in various ways by a skilled person within the scope of the claims. Any embodiment based on a proper combination of technical means disclosed in different embodiments is also encompassed in the technical scope of the present invention.

DESCRIPTION OF NOTATIONS

10, 11, and 12 Airtight chamber
15 Hose
20 Pump oscillating pressure control unit
**100-1-100-*n*** Speaker/Sensor
**101-1-101-*n*** Liquid pressure additional unit
**102-1-102-*n*** Oscillating additional unit
105 Head Section
106 Fluid
110 Exciter
120 Temperature Control Unit
125 Passage
130 Sensor
140 Attaching Part
150, 151 Bed
153 Sheet
154 Tube
155 Weight Sensor
160 Hinge
190 Air Pressure Sensor
200 Control Unit
210 Power Supply Unit
220 Storage Unit
230 I/O Unit
240 Display
251 Oscillating Pressure Adjustment Unit
253 Air Pressure Controller
255 Tissue Hardness Calculation Unit
257 Blood Distribution Calculation Unit
260 Input Unit
290 Vacuum Pump Unit
295 Sterilization Unit
500 Skin
600 Heart
610, 620 Blood pressure
710, 730 Air pressure
720 Water Pressure
740 Difference Pressure
750 Oscillating Pressure
800, 810, 820, 830 Monitor
X, Y Therapeutic Apparatus

What is claimed is:

1. A therapeutic apparatus for recovering a subject from fatigue, comprising:

a plurality of oscillating pressure addition units to apply an oscillating pressure to the subject;

a negative pressure unit, comprising a chamber configured to accept a whole body of a subject, and configured to reduce air pressure for the whole body of the subject from atmospheric pressure;

sensors to detect a state for a body surface of the subject; and an adjustment device to adjust an output distribution of each of the oscillating pressure addition units;

wherein the plurality of oscillating pressure addition units is configured to provide the oscillating pressure to the body surface at the same time as the negative pressure unit reduces the air pressure to the body surface, wherein the plurality of oscillating pressure addition units is configured to gradually increase the oscillating pressure while the negative pressure unit gradually reduces the air pressure, and wherein the oscillating pressure compensates for an increase of a burden for a heart and an arterial system due to the reduced air pressure with an auxiliary effect of cardiovascular pumping action by adding oscillation to the body surface.

2. The therapeutic apparatus according to claim 1, wherein the adjustment device controls an output of negative pressure or the oscillating pressure based on a value detected by the sensors; and the sensors comprise one or both of a) sensors to detect a state of hardness for the body surface of the subject and b) sensors to detect a blood flow for the body surface of the subject.

3. The therapeutic apparatus according to claim 2, wherein the sensors to detect the state of hardness for the body surface of the subject include a plurality of thermometers for detecting displacement of the body surface caused by the applied oscillating pressure by measuring body surface temperature of the subject from different directions with the plurality of thermometers and grasping temperature variation within a therapy space in three dimensions and measuring the state of the hardness for the body surface of the subject based on a correlation of hardness with body surface displacement and a magnitude of the oscillating pressure.

4. The therapeutic apparatus according to claim 2, wherein the sensors to detect the state of hardness for the body surface of the subject detect microwaves irradiated from radar elements to the body surface of the subject and reflected by the body surface of the subject to detect displacement of the body surface caused by the applied oscillating pressure and measure the state of hardness for the body surface of the subject based on a correlation of hardness with body surface displacement and a magnitude of the oscillating pressure.

5. The therapeutic apparatus according to claim 1, further comprising:

a monitor to obtain an output from each of the sensors in real time.

6. The therapeutic apparatus according to claim 2, further comprising:

a bed of meshed shape in which the subject is laid by supine or prone, wherein the plurality of oscillating pressure addition units are arranged to surround the subject.

7. The therapeutic apparatus according to claim 3, wherein the adjustment device uses a control unit to capture a motion of the body surface within the therapy space for the subject by the body surface temperature of the subject from different directions with the plurality of thermometers to detect displacement of the body surface caused by the applied oscillating pressure and determines the state of hardness for the body surface of the subject based on a correlation of hardness with body surface displacement and a magnitude of the oscillating pressure.

8. The therapeutic apparatus according to claim 1, wherein the adjustment device stores data having transition of a vital sign including blood pressure and a pulse of the subject during therapy for every therapy, stores the data in a database, and sets the data in correspondence with the subject.

9. The therapeutic apparatus according to claim 1, wherein the oscillating pressure addition unit is a sound wave generator to apply a sound wave to the subject.

10. The therapeutic apparatus according to claim 9, wherein the adjustment device uses an active noise controller for negating a phase of the sound wave or conversely emphasizing a difference in a strength of the sound wave by overlapping and reinforcing the phase of the sound wave, or uses the active noise controller to remove an artifact including the sound wave added to the subject or an echo of the sound wave after being added.

11. The therapeutic apparatus according to claim 1, wherein the sensors provide said detection of the state of the body surface without contacting the body of the subject.

12. The therapeutic apparatus according to claim 1, wherein the plurality of oscillating pressure addition units comprises a plurality of liquid pressure addition parts to inject a fluid towards the subject.

13. The therapeutic apparatus according to claim 12, wherein the adjustment device adjusts an output of the fluid to be applied to the oscillating pressure by liquid pressure intermittently.

14. The therapeutic apparatus according to claim 12, further comprising a flexible sheet to enclose at least a part of the body surface of the subject, and the plurality of liquid pressure addition parts inject the fluid intermittently toward the body surface of the subject from the outside of the sheet and applies the oscillating pressure to the body surface of the subject.

15. The therapeutic apparatus according to claim 14, wherein the sensors read a position of a position presenting part of the sheet, measure a shape and a modification position of the sheet, and detect a state of the body surface of the subject.

16. The therapeutic apparatus according to claim 1, further comprising a sterilization unit to sterilize an inside of the apparatus for every therapy.

17. The therapeutic apparatus according to claim 1, wherein the therapeutic apparatus comprises a control unit that determines a change in hardness based on levels of hardness detected at respective times and/or determines a change in blood flow based on levels of blood flow detected at respective times and then determines a strength of stiffness based on the determined change in hardness and/or the determined change in blood flow; and the adjustment device is configured to adjust an output distribution of each of the oscillating pressure addition units such that a strongest oscillating pressure is applied to a part of the body surface which exhibits a strongest stiffness.

18. A therapeutic method for recovering a subject from fatigue, comprising the steps of:

reducing air pressure for a whole body of the subject from atmospheric pressure by a negative pressure unit;

applying an oscillating pressure to the subject by a plurality of oscillating pressure addition units;

detecting a state of hardness for a body surface of the subject or a blood flow for the body surface of the subject by sensors; and adjusting an output distribution of each of the oscillating pressure addition units, wherein the oscillating pressure is provided at the same time as the air pressure is reduced, wherein the oscillating pressure is gradually increased while the air pressure is gradually reduced, and wherein the oscillating pressure compensates for an increase of a burden for a heart and an arterial system due to reduced air pressure imparted by the step of reducing air pressure, with an auxiliary effect of cardiovascular pumping action by adding oscillation to the body surface.

* * * * *